US009844737B1

(12) United States Patent
Warner et al.

(10) Patent No.: US 9,844,737 B1
(45) **Date of Patent: *Dec. 19, 2017**

(54) SELF-SEALING BALLOON AND METHOD OF MANUFACTURE

(71) Applicants: Wesley Warner, Anaheim, CA (US); Troy Stark, Weston, FL (US)

(72) Inventors: Wesley Warner, Anaheim, CA (US); Troy Stark, Weston, FL (US)

( * ) Notice: Subject to any disclaimer, the term of this patent is extended or adjusted under 35 U.S.C. 154(b) by 45 days.

This patent is subject to a terminal disclaimer.

(21) Appl. No.: 14/930,646

(22) Filed: Nov. 2, 2015

Related U.S. Application Data

(63) Continuation-in-part of application No. 13/952,608, filed on Jul. 27, 2013, now Pat. No. 9,174,141.

(60) Provisional application No. 61/676,969, filed on Jul. 29, 2012, provisional application No. 62/103,520, filed on Jan. 14, 2015.

(51) Int. Cl.
*A63H 27/10* (2006.01)

(52) U.S. Cl.
CPC ..... *A63H 27/10* (2013.01)

(58) Field of Classification Search
CPC ..... A63H 27/10
See application file for complete search history.

(56) References Cited

U.S. PATENT DOCUMENTS

| | | | | |
|---|---|---|---|---|
| 2,597,924 | A | 5/1952 | Davenport et al. | |
| 3,108,396 | A | 10/1963 | Dorman | |
| 4,560,360 | A | 12/1985 | Isaacs et al. | |
| 4,911,379 | A | 3/1990 | Kopelman | |
| 5,084,061 | A | 1/1992 | Gau et al. | |
| 5,282,930 | A | 2/1994 | Lang | |
| 5,334,072 | A | 8/1994 | Epstein | |
| 5,776,291 | A | 7/1998 | Lang | |
| 6,015,472 | A | 1/2000 | Garcia | |
| 6,183,591 | B1 | 2/2001 | Lang | |
| 2005/0176339 | A1 * | 8/2005 | Cuisinier | A63H 27/10 446/220 |
| 2007/0167107 | A1 | 7/2007 | Pete, II et al. | |
| 2009/0242450 | A1 | 10/2009 | Zhang et al. | |

(Continued)

FOREIGN PATENT DOCUMENTS

| | | |
|---|---|---|
| WO | WO 88/05328 | 7/1988 |
| WO | WO 90/00430 | 1/1990 |

*Primary Examiner* — Gene Kim
*Assistant Examiner* — Jeffrey Vanderveen
(74) *Attorney, Agent, or Firm* — Allen D. Hertz, P.A.; Allen D. Hertz

(57) ABSTRACT

A self-sealing balloon comprising a tubular balloon neck segment extending from an opening of a balloon gas retaining expansion cavity. A bead of moldable adhesive material is applied in a ring about an interior circumference of a neck portion of the balloon forming a dispensed adhesive roll. The dispensed adhesive roll is at least partially encapsulated within an adhesive staging segment. The adhesive staging segment is encased within a rolled lip bead by any suitable process. The rolling process aids in forming the ring-shaped adhesive. In use, the balloon would be inflated. The lip bead would be unrolled, exposing the adhesive ring. The moldable adhesive would be compressed forming a seal, entrapping pressurized air within the balloon gas retaining expansion cavity. This provides a low cost, simple self-sealing solution for a balloon.

20 Claims, 28 Drawing Sheets

(56) References Cited

U.S. PATENT DOCUMENTS

| | | | | |
|---|---|---|---|---|
| 2010/0255226 | A1 | 10/2010 | Heffernan | |
| 2011/0151744 | A1* | 6/2011 | Archer | A63H 27/10<br>446/222 |

* cited by examiner

SELF-SEALING BALLOON AND METHOD OF MANUFACTURE

CROSS-REFERENCE TO RELATED APPLICATION

This Non-Provisional Patent Application is a Continuation-In-Part claiming the benefit of:

U.S. Non-Provisional patent application Ser. No. 13/952,608, filed on Jul. 27, 2013 (scheduled to issue as U.S. Pat. No. 9,174,141 on Nov. 3, 2015), which claims the benefit of U.S. Provisional Patent Application Ser. No. 61/676,969, filed on Jul. 29, 2012; and U.S. Provisional Patent Application Ser. No. 62/103,520, filed on Jan. 14, 2015.

FIELD OF THE INVENTION

The present invention relates to a self sealing balloon assembly and method of manufacturing the same, and more particularly, a rubber or latex balloon having a moldable adhesive loop embedded within an adhesive staging segment formed as an annular loop within a neck segment of a balloon.

BACKGROUND OF THE INVENTION

Balloons are designed having a variety of shapes and sizes and are fabricated of any of a wide selection of suitable gas impervious materials, including: Mylar, latex, rubber, and the like. A pressurized gas, such as air, helium, nitrogen, and the like is used to inflate the balloon. The pressurized gas enters a balloon gas retaining expansion cavity through a balloon neck segment. The pressurized gas expands the balloon gas retaining expansion cavity. The pressurized gas is retained within the expanded balloon gas retaining expansion cavity by sealing a fill conduit provided through the balloon neck segment. This is commonly accomplished by tying a knot in the balloon neck segment.

The process of sealing pressurized gas within the expanded balloon gas retaining expansion cavity by tying a knot in the balloon neck segment presents a number of drawbacks. Initially, the process is very tedious and time consuming. The cycle time for the process of tying each balloon neck impacts the overall efficiency and profit for balloon preparation party. Once the neck of the balloon is tied into a knot, it is nearly impossible to untie the knot in order to deflate and reuse the balloon.

Latex balloons are formed by applying latex, in a liquid form, onto a balloon form and curing the latex. The elasticity of the latex enables removal of the formed and cured balloon from the balloon form. Mylar balloons are fabricated by adhering two sheets of Mylar together in accordance to a predetermined peripheral shape. Characteristics of the Mylar material direct the balloon fill process away from tying a knot in the neck segment. Conversely, tying a ribbon or similar material about the neck segment can seal the neck segment. Alternative sealing devices, such as sealing clips, and the like can be used to seal the neck segment.

In one known embodiment, a layer of adhesive tape is placed on an interior surface of the neck of the balloon. The adhesive tape is covered with a protective coating, which is removed when ready for use. The adhesive tape requires two planar surfaces to come together and join in a manner to provide a gaseous seal therebetween. Drawing two planar sheets of adhesive together to create a gaseous seal therebetween can be difficult. Any wrinkle or gap would provide an imperfection in the gaseous seal therebetween, thus creating a gas leak. Additionally, the adhesive tape can't be separated, thus eliminating any potential for deflating and reusing the balloon.

Accordingly, there remains a need in the art for a self-sealing balloon that provides a feature enabling a quick, reliable sealing process that can be separated, enabling deflation and reuse of the balloon.

SUMMARY OF THE INVENTION

The present invention overcomes the deficiencies of the known art and the problems that remain unsolved by providing an apparatus and method for quickly and reliably sealing a balloon.

In accordance with one embodiment of the present invention, the invention consists of a balloon comprising:

- a balloon body having a tubular balloon neck segment extending in fluid communication between a balloon unfinished edge and a balloon gas retaining expansion cavity;
- a moldable adhesive ring carried by an interior of the tubular balloon neck segment, the moldable adhesive ring having a moldable adhesive cross sectioned profile formed into a ring shape, the moldable adhesive ring circumscribing an interior circumference of a portion of a length of the interior of the tubular balloon neck segment; and
- an adhesive staging segment formed about a peripheral surface of the moldable adhesive cross sectioned profile of the moldable adhesive ring, the adhesive staging segment temporarily covering the peripheral surface of the moldable adhesive cross sectioned profile,
- wherein the adhesive staging segment is shaped from the tubular balloon neck segment.

In one aspect, the moldable adhesive has a pliable characteristic resembling clay.

In another aspect, the moldable adhesive is dispensed about a circumference of a balloon neck mold segment of a balloon form member. The moldable adhesive preferably forms a ring about a central, longitudinal axis of the balloon neck mold segment.

In yet another aspect, the adhesive staging segment is designed to expose the moldable adhesive ring when a tensile force is applied in a longitudinal direction between ends of the tubular balloon neck segment.

In yet another aspect, the adhesive staging segment is shaped as a loop covering the peripheral surface of the moldable adhesive cross sectioned profile, wherein the adhesive staging segment loop is formed by at least one of:

a portion of the tubular balloon neck segment spanning between the moldable adhesive ring and the balloon unfinished edge, and a portion of the tubular balloon neck segment spanning between the moldable adhesive ring and the balloon gas retaining expansion cavity.

In yet another aspect, the adhesive staging segment is designed to expose the moldable adhesive ring when a tensile force is applied in a longitudinal direction between ends of the tubular balloon neck segment.

In yet another aspect, the unfinished edge adhesive staging segment and the expansion cavity adhesive staging segment abut one another proximate an interior quadrant of the moldable adhesive cross sectioned profile.

In yet another aspect, a lip bead is formed at a balloon unfinished edge, wherein the balloon unfinished edge is provided at a free end of the tubular balloon neck segment.

In yet another aspect, the balloon body segment can be shaped in bulb shape, a star shape, an oblong shape, a square shape, a rectangular shape, a triangular shape, a hexagonal shape, an octagonal shape, a polygonal shape, and the like.

In accordance with a second embodiment of the present invention, the invention consists of a method for fabricating a self sealing balloon assembly, the method comprising the steps of:

obtaining a quick seal balloon fabrication form comprising at least one balloon form member, each of the at least one balloon form comprising a balloon body mold segment extending from a balloon neck mold segment and an adhesive material dispensing section located about a circumference of a central section of the balloon neck mold segment;

applying an adhesive material about an circumference of a portion of a length of an exterior surface of the balloon neck mold segment, the moldable adhesive ring having a moldable adhesive cross sectioned profile formed into a ring shape;

applying balloon material upon an exterior surface of the balloon body mold segment and further extending upward onto a portion of the balloon neck mold segment to a location beyond the adhesive material dispensing section, wherein the balloon material is applied to the quick seal balloon fabrication form either prior to or subsequent to the application of the adhesive material;

shaping an adhesive staging segment into a loop, wherein the adhesive staging segment at least partially encapsulates the moldable adhesive ring; and removing the shaped balloon from the quick seal balloon fabrication form.

In yet another aspect, the method further comprises a step of curing the balloon material.

In yet another aspect, wherein the step of shaping the adhesive staging segment into a loop is accomplished by using at least one roller. The roller would apply a frictional force to the exterior surface of the balloon material extending the material and forming the looped shape.

In yet another aspect, the method further comprises a step of generating a lip bead at a free end of the tubular balloon neck segment.

In yet another aspect, the method further comprises a step of utilizing the balloon material to aid in forming the dispensed adhesive roll.

In yet another aspect, the method further comprises a step of dispensing the adhesive material into a recess formed within the adhesive dispensing segment.

In yet another aspect, the step of shaping the adhesive staging segment into a loop is accomplished by using at least one roller, wherein roller would apply a frictional force to the exterior surface of the balloon material extending the material and forming the loop shape.

In yet another aspect, the step of shaping the adhesive staging segment into a loop is accomplished by using at least one roller, wherein roller would apply a frictional force to the exterior surface of the balloon material extending the material and forming the loop shape.

In yet another aspect, the step of shaping the adhesive staging segment into a loop is accomplished by:

forming an unfinished edge adhesive staging segment of the adhesive staging segment by rolling a portion of the tubular balloon neck segment spanning between the moldable adhesive ring and the balloon unfinished edge over an unfinished edge portion of the moldable adhesive cross sectioned profile, and forming an expansion cavity adhesive staging segment of the adhesive staging segment by rolling a portion of the tubular balloon neck segment spanning between the moldable adhesive ring and the balloon gas retaining expansion cavity over an expansion cavity portion of the moldable adhesive cross sectioned profile.

In yet another aspect, at least one of the step of forming the unfinished edge adhesive staging segment and the step of forming the expansion cavity adhesive staging segment is accomplished by applying a friction to an exterior surface of the tubular balloon neck segment.

In yet another aspect, the adhesive material is dispensed into a recess formed within the adhesive material dispensing section.

In accordance with a third embodiment of the present invention, the invention consists of a method for fabricating a self sealing balloon assembly, the method comprising the steps of:

introducing an adhesive dispensing adapter onto a balloon form comprising a balloon neck mold segment extending axially from a balloon body bulb shaped mold segment, wherein the adhesive dispensing adapter circumscribes the balloon neck mold segment and includes an adhesive dispensing system integrated therein, the adhesive dispensing system comprising an adhesive material dispensing section;

applying balloon material upon an exterior surface of the balloon body mold segment and further extending upward onto a portion of the balloon neck mold segment, continuing onto an exterior surface of the adhesive dispensing adapter;

dispensing an adhesive composition through the adhesive dispensing adapter to form a bead about a neck portion of the balloon;

forming the balloon material to at least partially surround the adhesive composition bead; and removing the shaped balloon from the quick seal balloon fabrication form.

In yet another aspect, the adhesive material dispensing section is provided as a gap formed between a lower edge of the adhesive dispensing adapter and an exterior surface of the balloon neck mold segment.

In yet another aspect, the adhesive material dispensing section is provided as a series of orifices formed through a body of the adhesive dispensing adapter.

In yet another aspect, the series of orifices are formed through the body of the adhesive dispensing adapter at a location proximate a lower edge of the body of the adhesive dispensing adapter.

In yet another aspect, the adhesive dispensing adapter is adapted to employ a pressure to aid in the dispensing of the adhesive composition. The pressure can be provided by a flow of adhesive into the adhesive dispensing adapter, air pressure or another gaseous propellant, and the like.

In yet another aspect, the balloon material is formed in a shape of a roll, encapsulating the adhesive bead.

In yet another aspect, the balloon material is formed in a "C" shape, encapsulating the adhesive bead therein.

In yet another aspect, a powder is applied to an exposed surface of the adhesive bead prior to encapsulating the adhesive bead within the balloon material.

In yet another aspect, the self sealing balloon is inflated by steps of:

inflating the balloon gas retaining expansion cavity with a volume of material;

applying a tensile force in a longitudinal direction between ends of the tubular balloon neck segment to expose the moldable adhesive ring from the adhesive staging segment;

compressing the exposed moldable adhesive ring together forming a seal, thus entrapping the volume of material within the balloon gas retaining expansion cavity.

In yet another aspect, the method is accomplished by automating the process.

In yet another aspect, the step of applying balloon material upon an exterior surface of the balloon body mold segment and further extending upward onto a portion of the balloon neck mold segment is accomplished by at least one of a dipping process, a spray process, a brush application process, a rolling application process, and the like.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Figure 1:
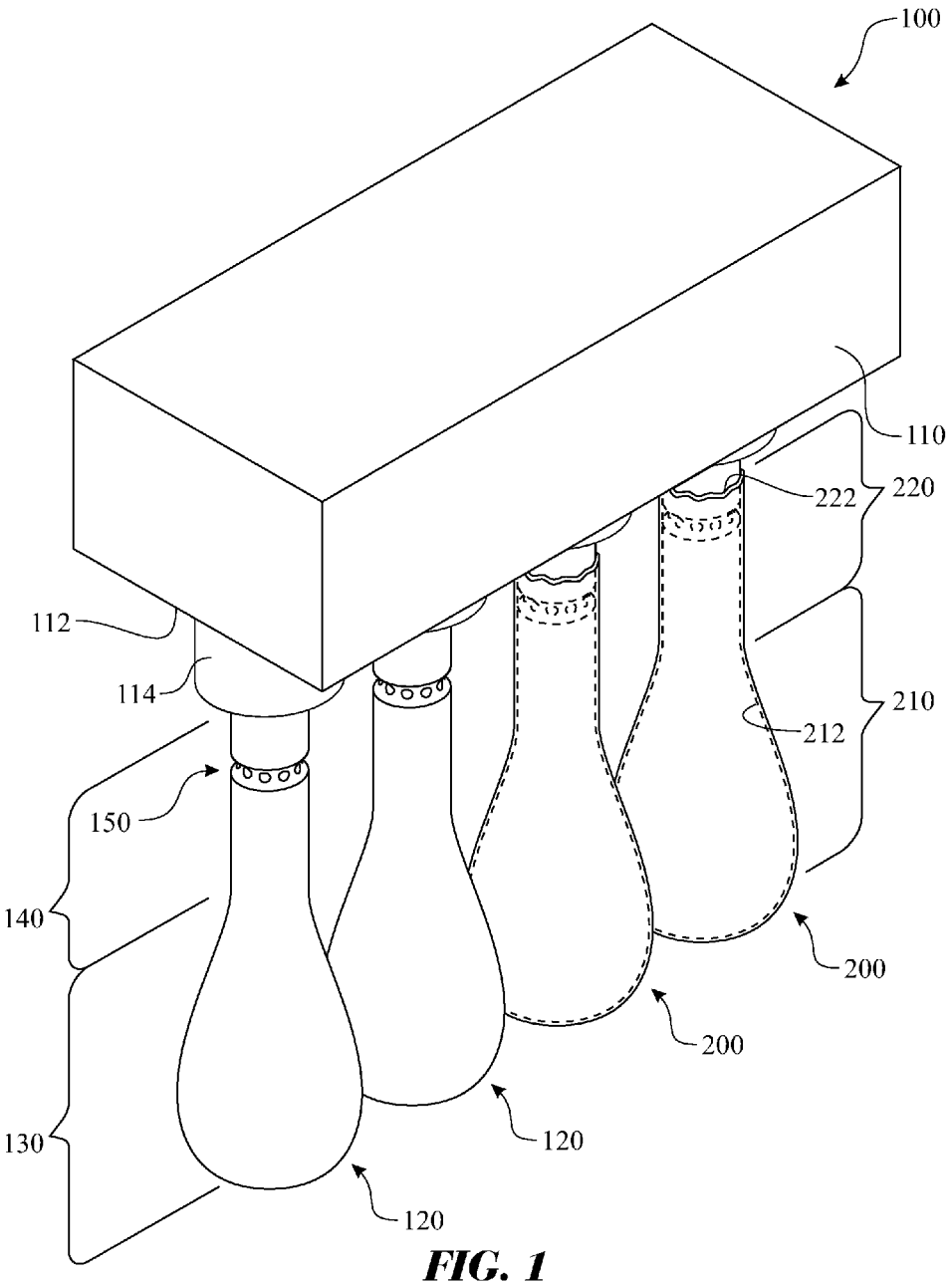
FIG. 1 presents an isometric view of an exemplary quick seal balloon fabrication form, the illustration including two exemplary uncoated forms and two exemplary forms coated with balloon forming material.

Detailed embodiments of the present invention are disclosed herein. It will be understood that the disclosed embodiments are merely exemplary of the invention that may be embodied in various and alternative forms. The figures are not necessarily to scale, and some features may be exaggerated or minimized to show details of particular embodiments, features, or elements. Specific structural and functional details, dimensions, or shapes disclosed herein are not limiting but serve as a basis for the claims and for teaching a person of ordinary skill in the art the described and claimed features of embodiments of the present invention. The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

One or more balloons 200 are formed using a quick seal balloon fabrication form 100 as illustrated in FIGS. 1 through 9. The exemplary embodiment of the quick seal balloon fabrication form 100 presented in FIG. 1 includes four (4) balloon form member 120, wherein two (2) of the four (4) balloon form members 120 are coated with a balloon forming material to create an exemplary self sealing balloon 200.

Figure 2:
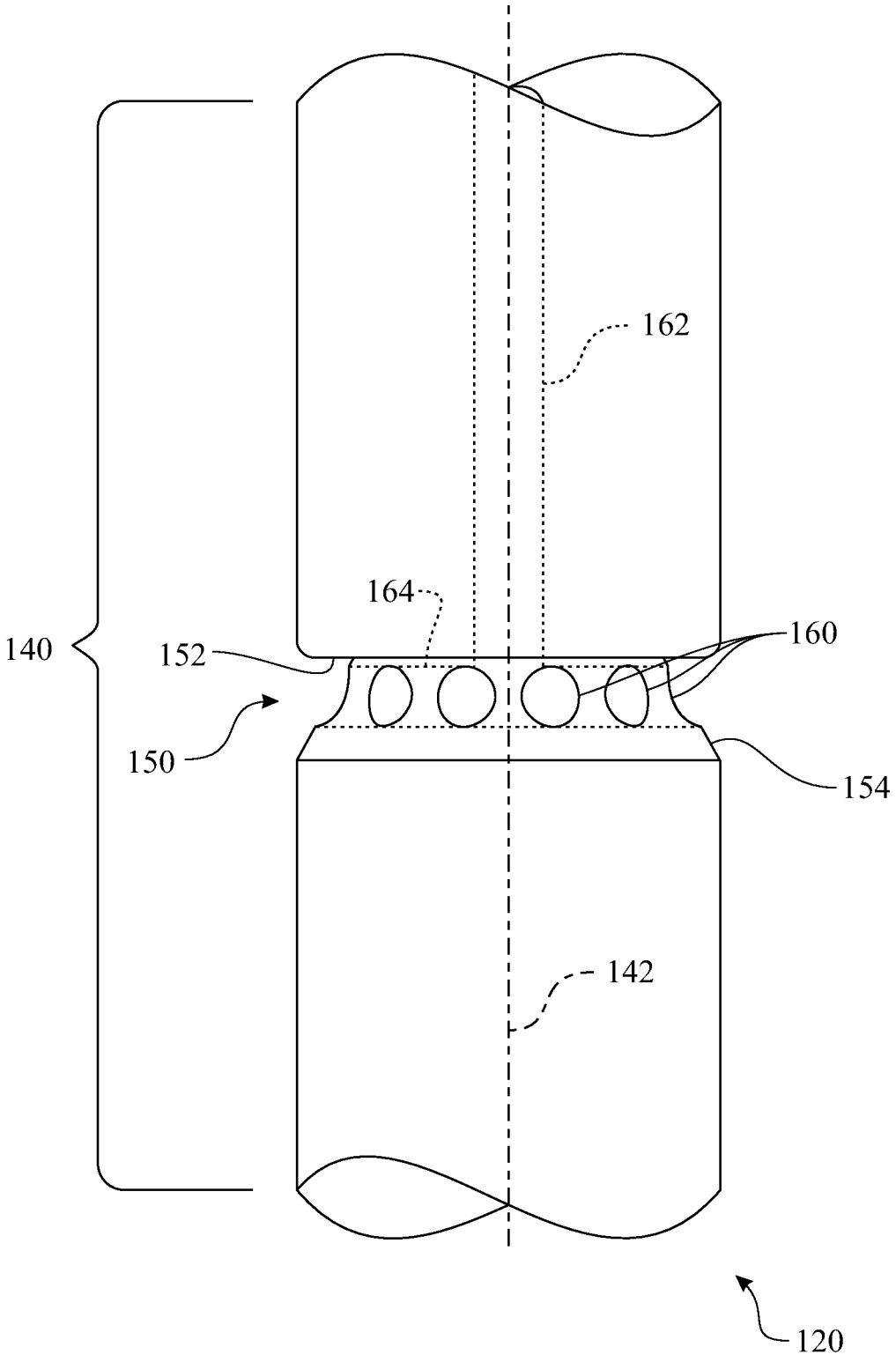
FIG. 2 presents an enlarged elevation view detailing an exemplary adhesive dispensing segment of an exemplary balloon neck mold segment of the exemplary quick seal balloon fabrication form originally introduced in FIG. 1, wherein the neck segment is shown prior to dispensing of a moldable adhesive.

Each balloon form member 120 is shaped to include a balloon body mold segment 130 extending from a balloon neck mold segment 140. The balloon body mold segment 130 can be shaped in any desired shape, wherein the shape of the balloon body mold segment 130 defines the shape of the finished balloon gas retaining expansion cavity 210. The balloon neck mold segment 140 is preferably shaped having a circular cross sectional shape to form a circular, tubular balloon neck segment 220. An adhesive dispensing segment 150 is provided in a central region of the balloon neck mold segment 140 as illustrated in FIG. 2. The exemplary adhesive dispensing segment 150 is formed including a recess defined having a base adhesive control surface 152 and an angled adhesive control surface 154. The base adhesive control surface 152 extends laterally inward from a circumference of the neck mold segment exterior surface. The angled adhesive control surface 154 extends outward and downward from an interior edge of the base adhesive control surface 152, wherein the angled adhesive control surface 154 terminates at an exterior surface of the balloon neck mold segment 140. The base adhesive control surface 152 and angled adhesive control surface 154 are provided to aid in guiding the separation of a dispensed adhesive roll 170 from the adhesive dispensing segment 150. A series of adhesive dispensing aperture 160 are provided in a spatial arrangement about the angled adhesive control surface 154. A series of adhesive distribution delivery conduit 164 are provided connecting each of the adhesive dispensing aperture 160 to an adhesive primary delivery conduit 162. The adhesive dispensing aperture 160 and respective adhesive distribution delivery conduit 164 can be fabricated in the balloon neck mold segment 140 by drilling a hole completely through the balloon neck mold segment 140. The adhesive distribution delivery conduit 164 preferably is directed bisecting a longitudinal axis 142 of the balloon neck mold segment 140. The adhesive primary delivery conduit 162 is preferably formed extending concentrically along the balloon neck mold segment longitudinal axis 142.

The adhesive roll 170 is formed as a moldable adhesive ring having a moldable adhesive cross sectioned profile formed into a ring or annular shape. The fabrication process positions the moldable adhesive ring 170 to circumscribe an interior circumference of a portion of a length of an interior of the tubular balloon neck segment 220. An adhesive staging segment 172 will be formed from the tubular balloon neck segment 220, wherein the adhesive staging segment 172 will at least partially cover a peripheral surface of the moldable adhesive cross sectioned profile 180.

It is understood that the adhesive roll 170 can be applied using other application methods, including rolling, forming, and the like. The dispensed adhesive roll 170 can be fabricated of any suitable material, wherein one exemplary material is a high tack pressure sensitive adhesive solder under a Product Number 3794 offered by 3M and a second exemplary material is a reusable putty sold under a brand name of DAP BLUESTIK offered by DAP Products incorporated.

The dispensed adhesive roll 170 can be fabricated of a thermoplastic general purpose, high tack, pressure sensitive adhesive that can be spray or bead applied. The chemical base is a block co-polymer. The adhesive material preferably conforms to ASTM D 4236. The composition of the adhesive material can include a rubber-based vehicle.

Although the exemplary embodiment presents an adhesive dispensing segment 150 having a recess formed about a circumference of the balloon neck mold segment 140, it is understood that the adhesive dispensing segment 150 can comprise the plurality of adhesive dispensing apertures 160 in fluid communication with the adhesive primary delivery conduit 162 via a series of adhesive distribution delivery conduits 164, exclusive of the recess formed by the base adhesive control surface 152 and angled adhesive control surface 154.

The exemplary quick seal balloon fabrication form 100 includes a fabrication manifold 110. The fabrication manifold 110 would include a series of fluid conduits (not shown) forming a manifold for transferring an adhesive material from an adhesive material reservoir (not shown) to each of the individual form transition member 114 via any transfer mechanism. The transfer mechanism can be a pump, a pressurized system, and the like. A series of individual form transition member 114 (or similar feature) can be integrated into the fabrication manifold 110 or assembled to a fabrication manifold form surface 112 of the fabrication manifold 110, wherein each balloon form member 120 is attached to the fabrication manifold 110 via the individual form transition member 114. The individual form transition member 114 can provide fluid communication between the manifold of the fabrication manifold 110 and each respective adhesive primary delivery conduit 162. This configuration provides a single passageway for conveyance and disbursement of the adhesive material between the adhesive material reservoir and each of the adhesive dispensing segments 150.

The quick seal balloon fabrication form 100 is transferred placing the multiple balloon form members 120 attached thereto into a vat containing liquid balloon forming material. The liquid balloon forming material coats the balloon body mold segment 130 and balloon neck mold segment 140 of each of the balloon form members 120. The illustration shows two (2) of the four (4) balloon form members 120 being coated with liquid balloon forming material to present a before and after state. It is noted that the liquid balloon forming material is applied to the balloon form member 120, where the liquid balloon forming material covers the adhesive dispensing segment 150. A balloon unfinished edge 222 is created at the terminal end of the self sealing balloon 200.

Figure 3:
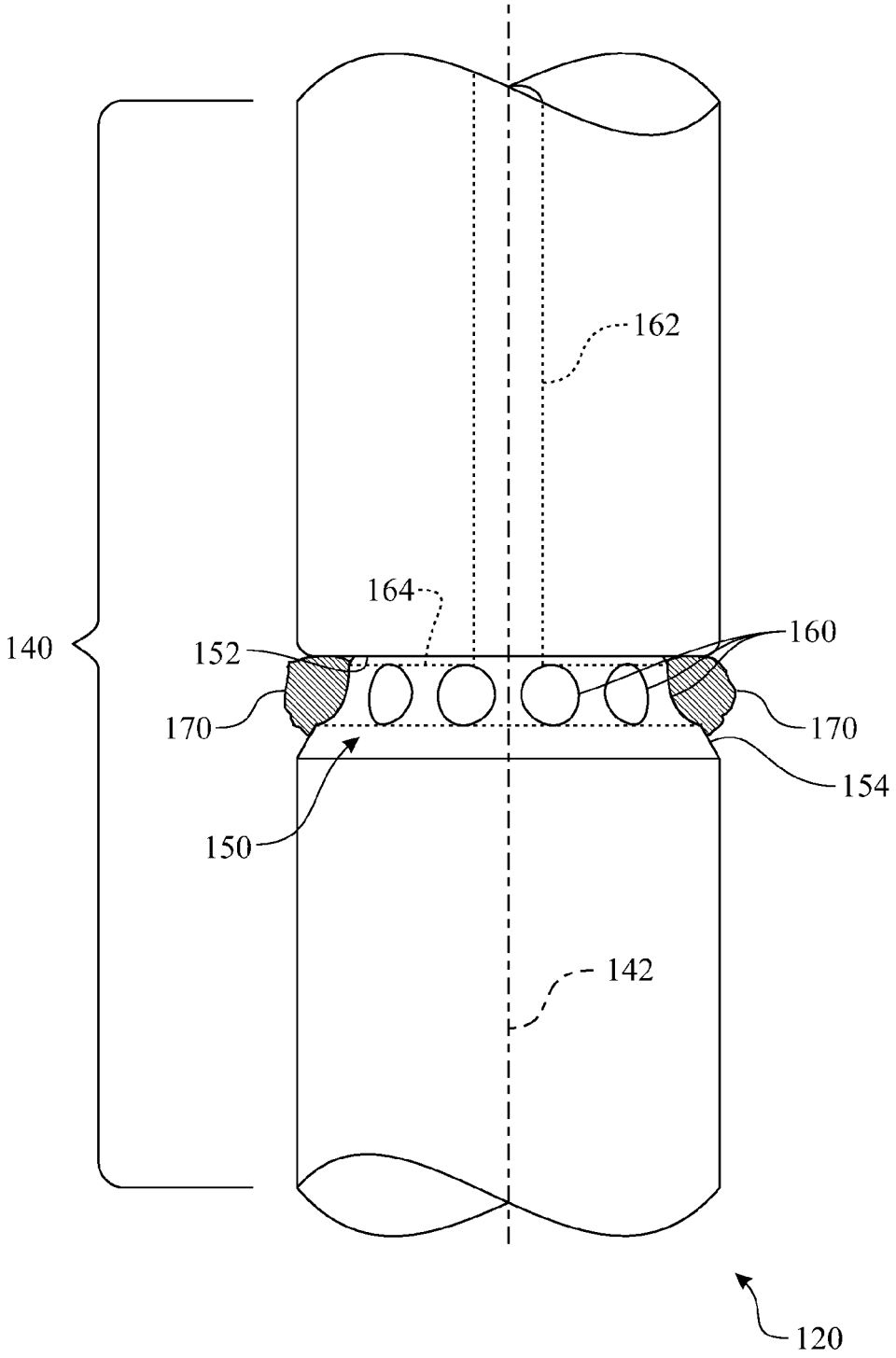
FIG. 3 presents a partially sectioned, enlarged elevation view detailing the exemplary adhesive dispensing segment as shown in FIG. 2, wherein the mold neck segment illustrates a cross section of an exemplary ring of moldable adhesive dispensed about the mold neck segment.
Figure 4:
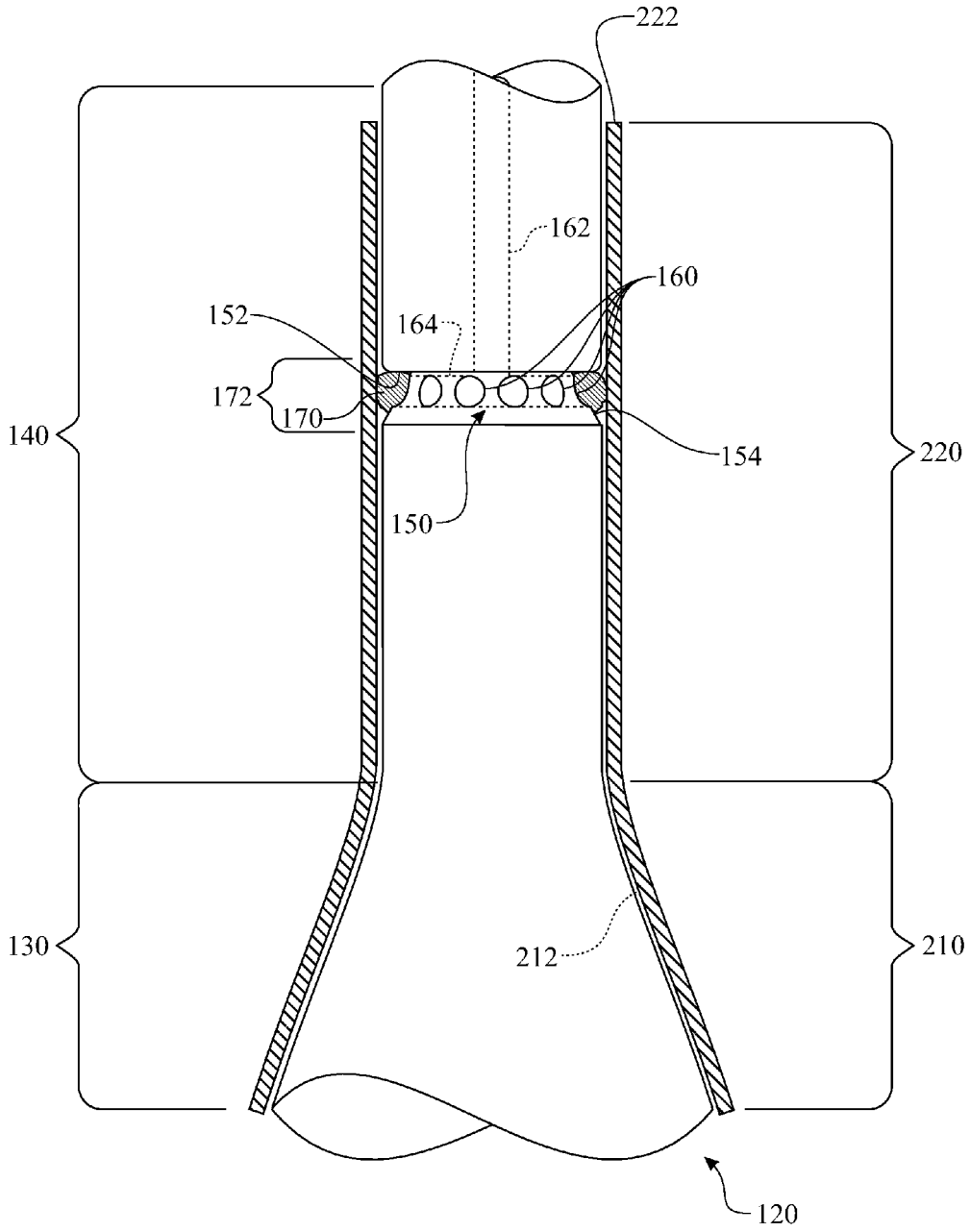
FIG. 4 presents a partially sectioned elevation view detailing the exemplary adhesive dispensing segment as shown in FIG. 3, the illustration introducing a coating of a balloon material applied to the balloon form member.

A volume of adhesive material is dispensed through the manifold, where the material is separated into each of the adhesive primary delivery conduit 162. The adhesive material continues through the adhesive primary delivery conduit 162, where it is disbursed into each of the adhesive distribution delivery conduits 164 and dispensed through the plurality of adhesive dispensing apertures 160. In a first embodiment, the adhesive material is dispensed prior to coating the balloon form member 120 with the balloon material as illustrated in FIG. 3. In a second embodiment, the adhesive material is dispensed subsequent to coating the balloon form member 120 with the balloon material as illustrated in FIG. 4. In this embodiment, the balloon material aids in retaining and forming the dispensed adhesive roll 170. The process allows for a curing step, where the balloon material is at least partially cured prior to continuing with the fabrication process.

The self sealing balloon 200 is subjected to a continuous flow of steps to form an adhesive staging segment 172 partially or completely encapsulating the dispensed adhesive roll 170 presented in the exemplary embodiments illustrated in FIGS. 5 through 8. In the exemplary embodiment, one or more adhesive staging segment rollers 190 applies a friction to an exterior surface of the tubular balloon neck segment 220, causing the adhesive staging segment 172 to extend and roll downward, towards the balloon gas retaining expansion cavity 210. The one or more adhesive staging segment rollers 190 are positioned about a circumference of the tubular balloon neck segment 220. The rolling process collects the dispensed adhesive roll 170 and entraps the dispensed adhesive roll 170 within the adhesive staging segment 172. In the exemplary embodiment, the adhesive dispensing segment 150 is shaped to include a base adhesive control surface 152 and an angled adhesive control surface 154. The base adhesive control surface 152 ensures the dispensed adhesive roll 170 is directed towards the balloon gas retaining expansion cavity 210. The angled adhesive control surface 154 aids in transferring the dispensed adhesive roll 170 from the adhesive dispensing segment 150 into the adhesive staging segment 172. In a scenario where the dispensed adhesive roll 170 is placed upon an outer surface of the balloon neck mold segment 140, the rolling process naturally transfers the dispensed adhesive roll 170 into the adhesive staging segment 172.

Figure 5:
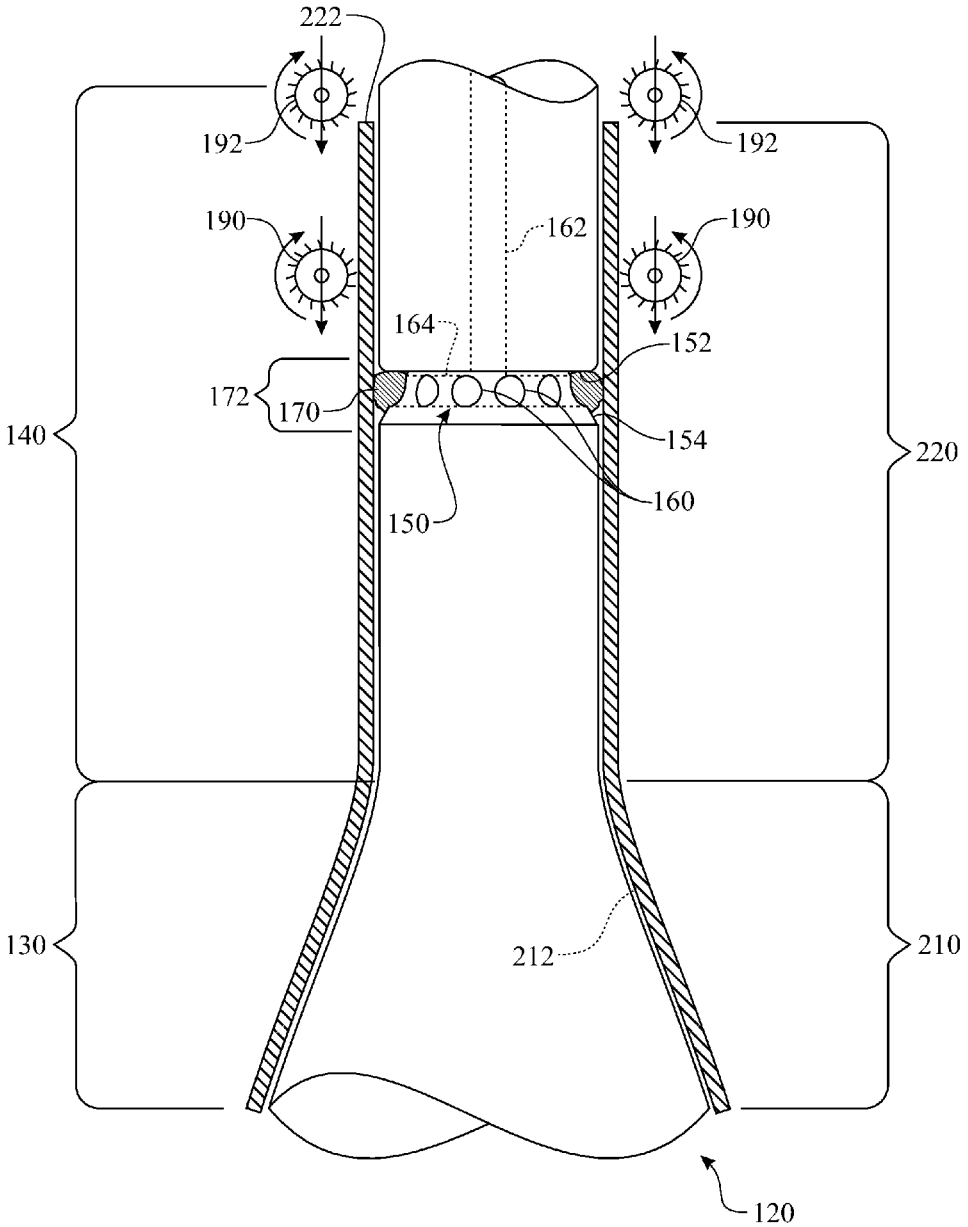
FIG. 5 presents a partially sectioned elevation view of the balloon neck mold segment detailing the exemplary adhesive dispensing segment as shown in FIG. 4, the illustration introducing various balloon feature forming rollers.
Figure 6:
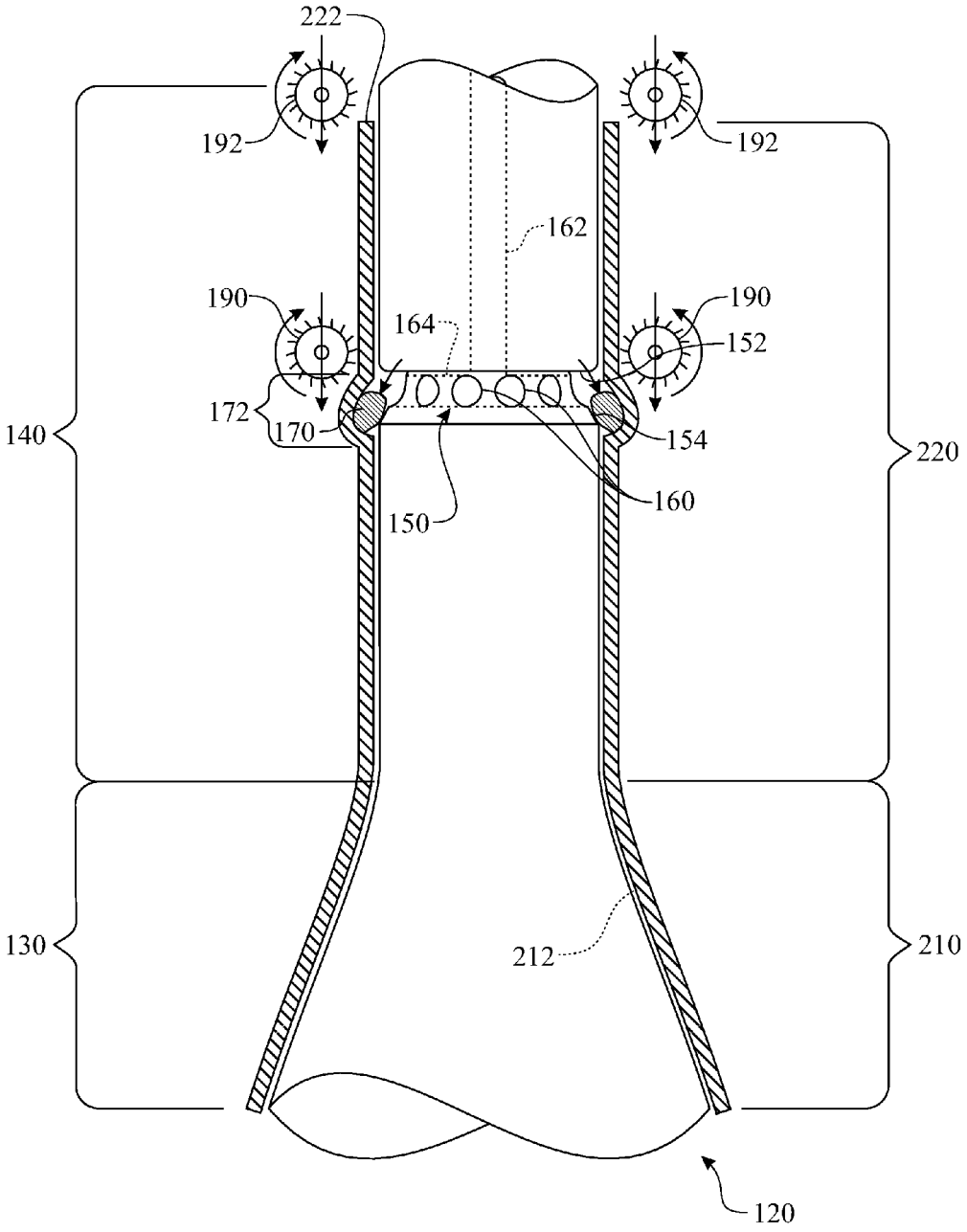
FIG. 6 presents a partially sectioned elevation view of the balloon neck mold segment illustrating an exemplary first step for forming an adhesive staging loop, wherein the first step removes the dispensed adhesive roll form the an adhesive dispensing segment of the form.
Figure 7:
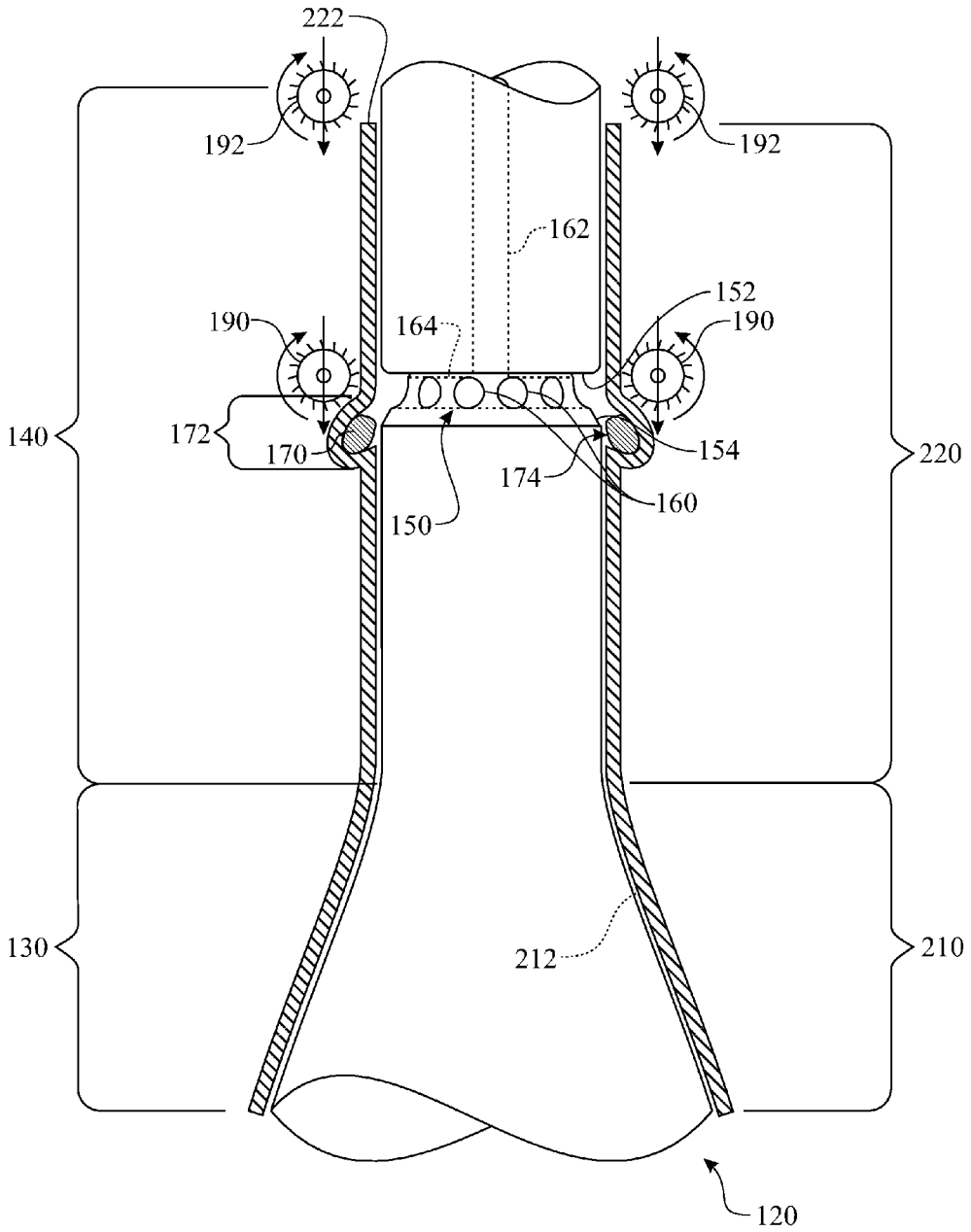
FIG. 7 presents a partially sectioned elevation view of the balloon neck mold segment illustrating an exemplary second step for forming an adhesive staging loop, wherein the second step partially encases the dispensed adhesive roll into an adhesive staging segment of the tubular balloon neck segment.

Initially, the rollers 190 apply a frictional force to the exterior surface of the tubular balloon neck segment 220, causing the adhesive staging segment 172 to extend and begin rolling downward, towards the balloon gas retaining expansion cavity 210 as illustrated in FIG. 5. The motion of the adhesive staging segment rollers 190 extracts the dispensed adhesive roll 170 from the adhesive dispensing segment 150 (when applicable), placing the dispensed adhesive roll 170 into the adhesive staging segment 172, as illustrated in FIG. 6. The dispensed adhesive roll 170 inhibits the downward motion of the adhesive staging segment 172, where when the collection of the dispensed adhesive roll 170 placing inside the adhesive staging segment 172 causes the adhesive staging segment 172 to roll when subjected to the continuing rolling and downward motion of the adhesive staging segment roller 190, as illustrated in FIG. 7. The process continues until the adhesive staging segment 172 is formed into an envelope substantially or completely circumscribing the dispensed adhesive roll 170. The looped dispensed adhesive roll 170 forms two transitional nodes or ends, which can define an adhesive staging segment gap 174. The adhesive staging segment gap 174 or relationship between the nodes can be configured where the nodes butt against one another, have a small spatial relation therebetween, or overlap.

The adhesive staging segment 172 can be defined as having two segments: an unfinished edge adhesive staging segment 182 and an expansion cavity adhesive staging segment 184. The unfinished edge adhesive staging segment 182 can be defined as a portion of the adhesive staging segment 172 extending from a midline of the dispensed adhesive roll 170 towards the balloon unfinished edge 222. The expansion cavity adhesive staging segment 184 can be defined as a portion of the adhesive staging segment 172 extending from a midline of the dispensed adhesive roll 170 towards the balloon body segment 210.

Although the balloon neck mold segment 140 is illustrated having parallel sides, the balloon neck mold segment 140 can have a taper, where the diameter or circumference proximate the fabrication manifold 110 is smaller than the diameter or circumference proximate the balloon body mold segment 130. The tapered configuration can aid in forming the adhesive staging segment 172.

The balloon unfinished edge 222 can be finished either prior to forming the adhesive staging segment 172, parallel to forming the adhesive staging segment 172, or subsequent to forming the adhesive staging segment 172. The balloon unfinished edge 222 is finished by rolling the free end of the tubular balloon neck segment 220 using at least one lip bead roller 192. The one or more lip bead rollers 192 are positioned about a circumference of the tubular balloon neck segment 220. The lip bead roller 192 frictionally engages with the interior surface 212 of the tubular balloon neck segment 220 causing the free end of the tubular balloon neck segment 220 to roll outward forming a lip bead 224.

Once completed, the self sealing balloon 200 is removed from the balloon form member 120 using any common balloon fabrication separation procedure.

Figure 10:
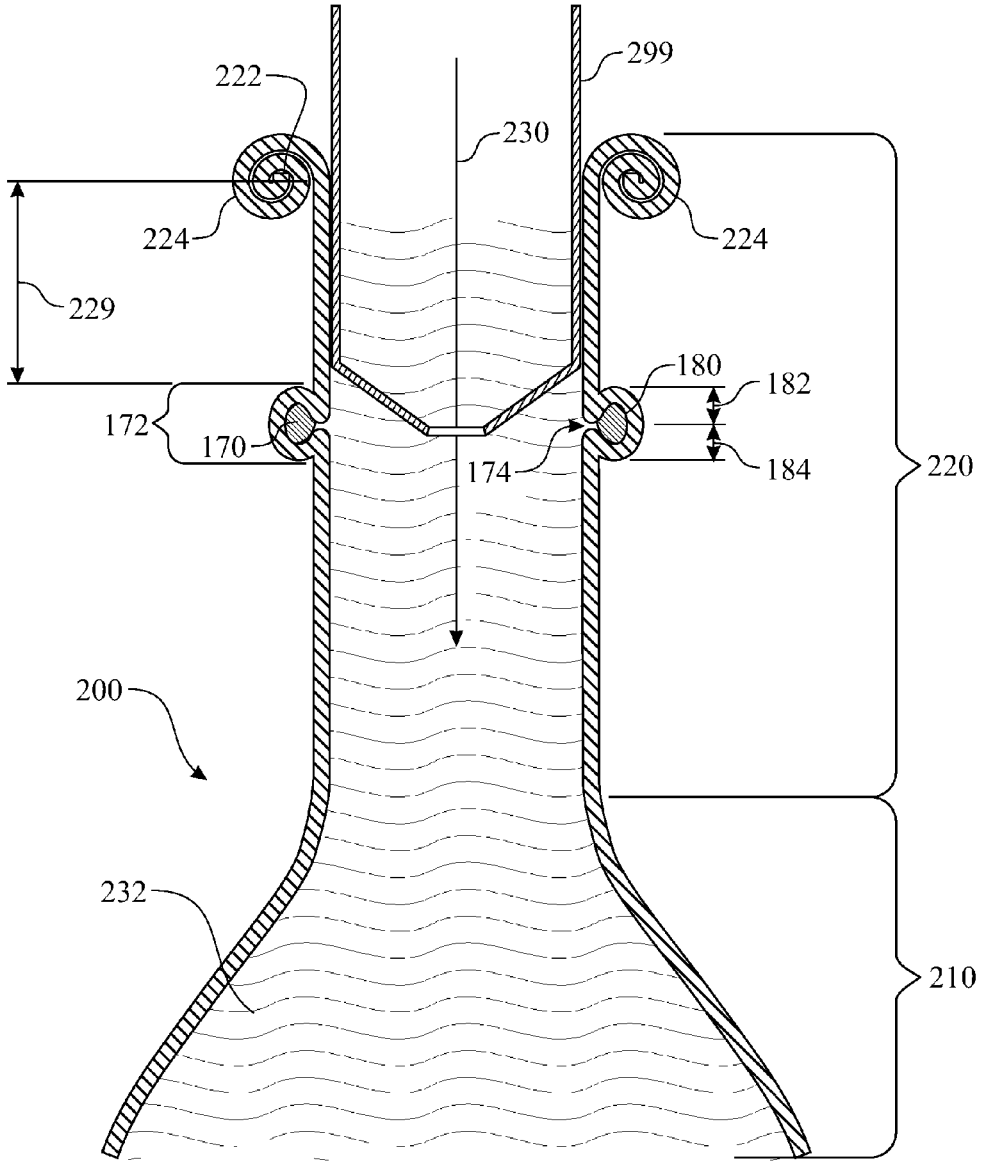
FIG. 10 presents a sectioned elevation view of the tubular balloon neck segment illustrating a first balloon filling step.
Figure 11:
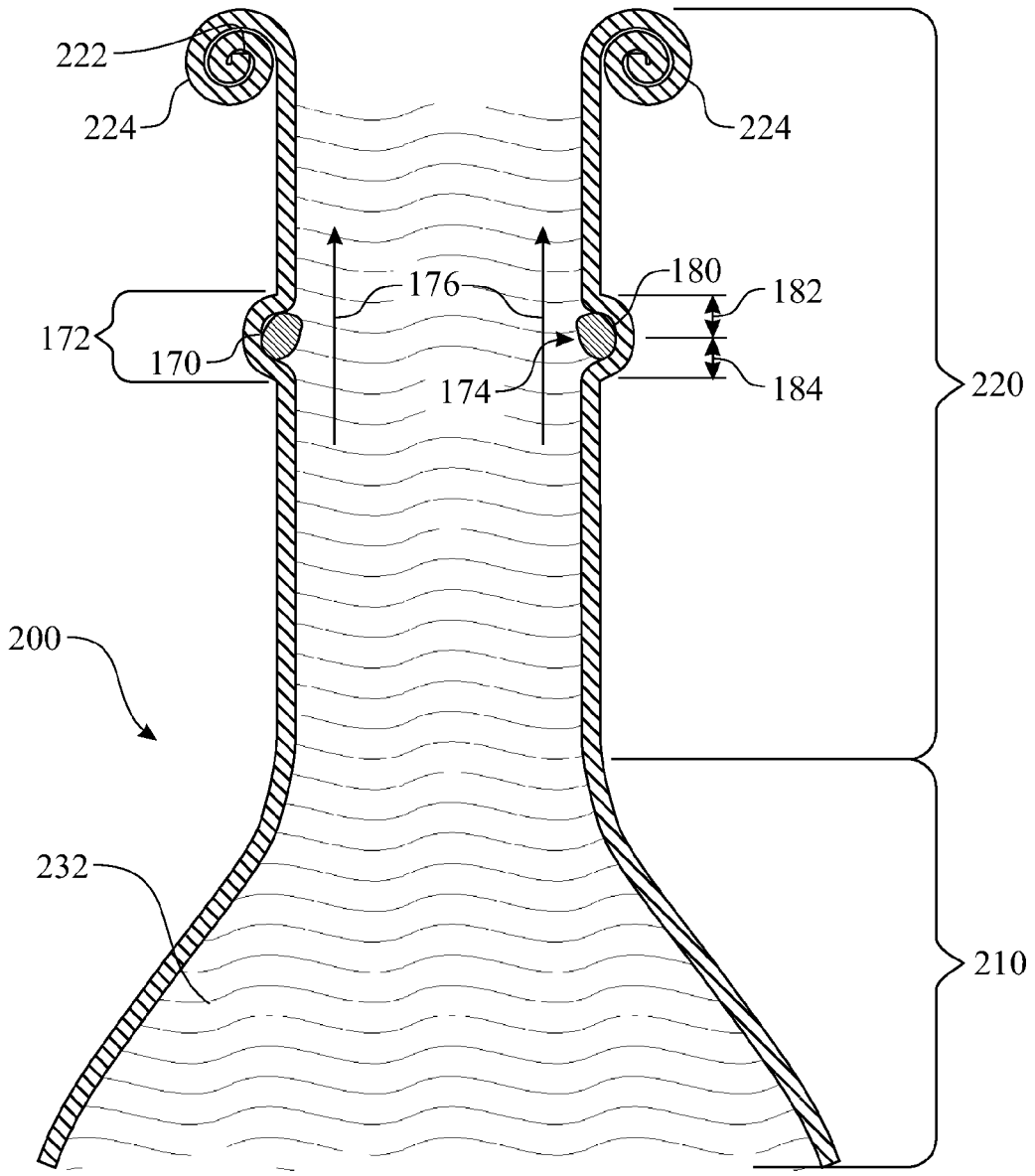
FIG. 11 presents a sectioned elevation view of the tubular balloon neck segment illustrating a first balloon sealing step.
Figure 12:
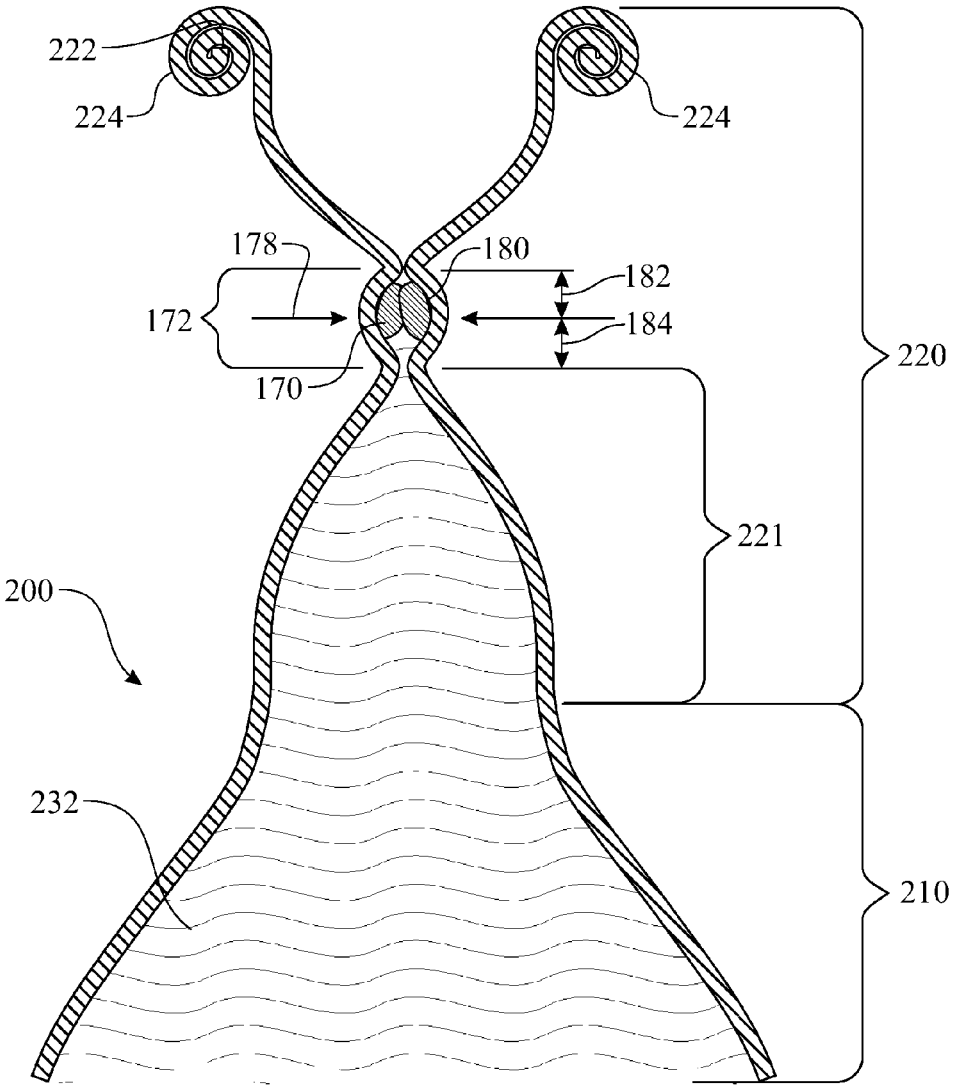
FIG. 12 presents a sectioned elevation view of the tubular balloon neck segment illustrating a second balloon sealing step.

In use, the self sealing balloon 200 is inflated by inserting pressurized inflating gas 230 into the balloon gas retaining expansion cavity 210, as illustrated in FIG. 10. The pressurized inflating gas 230 can be provided by any suitable inflating source, including a person, a pressurized gas supply through a compressed gas delivery nozzle 299, or any other suitable gas source. The gas can be air, helium, nitrogen, or any other desired gas. It is also understood that liquids may be used in place of the gas, such as water to create a water balloon. The pressurized inflating air 230 causes the balloon gas retaining expansion cavity 210 to expand to a desired size. Balloons 200 are commonly designed where the tubular balloon neck segment 220 begins to inflate when the balloon gas retaining expansion cavity 210 approaches maximum inflation. Once the balloon gas retaining expansion cavity 210 is inflated to the desired size, the balloon inflator would apply an adhesive exposing tensile force 176 to the tubular balloon neck segment 220, as illustrated in FIG. 11. The adhesive exposing tensile force 176 unrolls the adhesive staging segment 172, separating the nodes, which exposes the dispensed adhesive roll 170. The tubular balloon neck segment 220 is commonly held shut during the process of applying the adhesive exposing tensile force 176. The adhesive exposing tensile force 176 also tends to draw the internal circumferential edge of the dispensed adhesive roll 170 together. The balloon inflator would subsequently or simultaneously apply an adhesive bonding force 178 to the adhesive staging segment 172 as illustrated in FIG. 12. The adhesive bonding force 178 would collapse the dispensed adhesive roll 170, which would subsequently seal the tubular balloon neck segment 220. The adhesive material is preferably of a consistency resembling clay, putty, or the like. The compression generated by the adhesive bonding force 178 molds the adhesive material from a ring shape into a single, sealing blob. Once sealed, the adhesive bonding force 178 retains entrapped air 232 within the balloon gas retaining expansion cavity 210.

Any individual can deflate the self sealing balloon 200 by pulling the adhesive staging segment 172 open; separating the blob of adhesive material to form a venting passageway. The entrapped air 232 would be released through the venting passageway, deflating the balloon gas retaining expansion cavity 210. The deflated self sealing balloon 200 can be re-inflated and resealed if desired. It is noted that the re-inflation process can require additional finesse, as the dispensed adhesive roll 170 is no longer entrapped within the adhesive staging segment 172.

Figure 13:
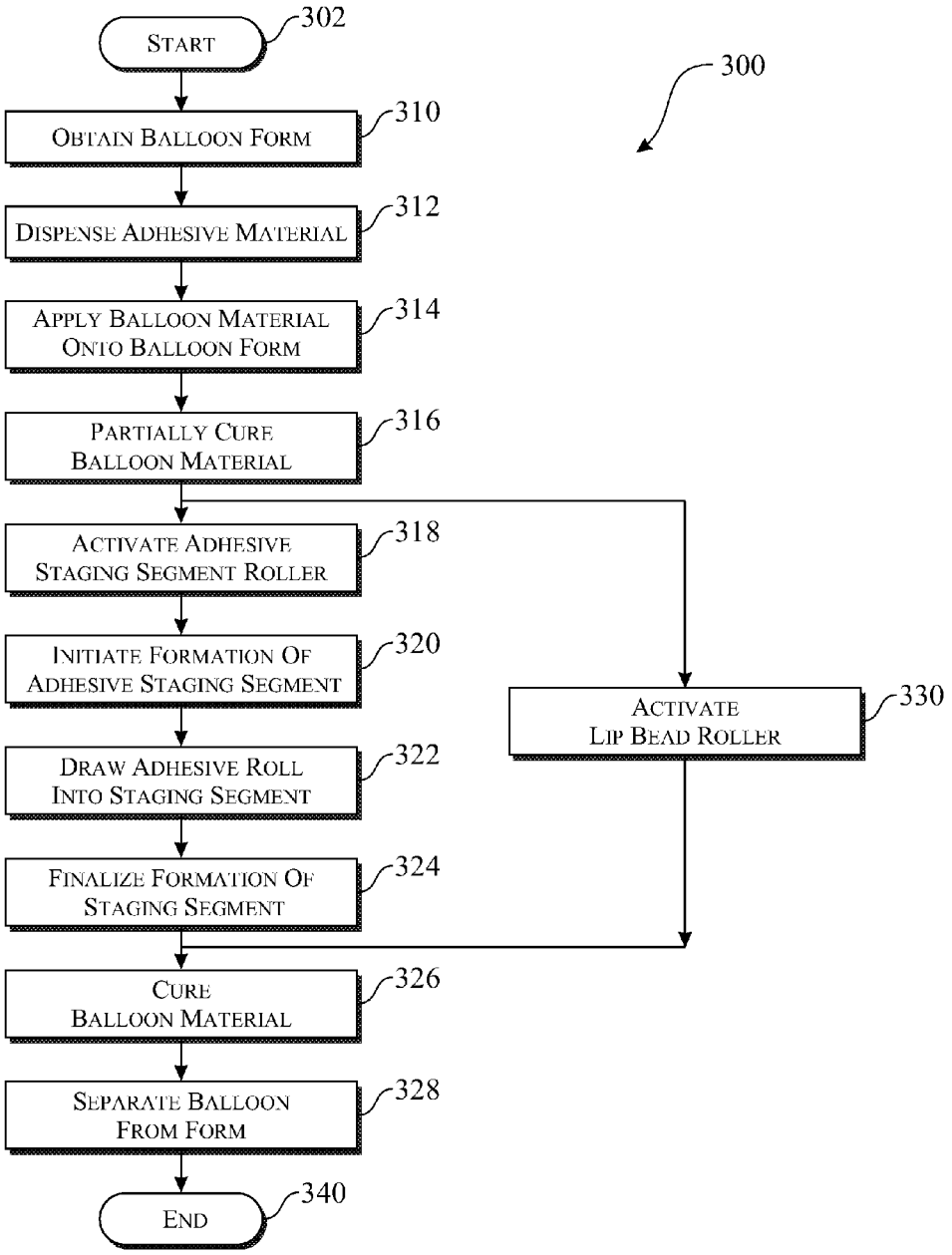
FIG. 13 presents a flow diagram detailing a first exemplary balloon fabrication process.
Figure 14:
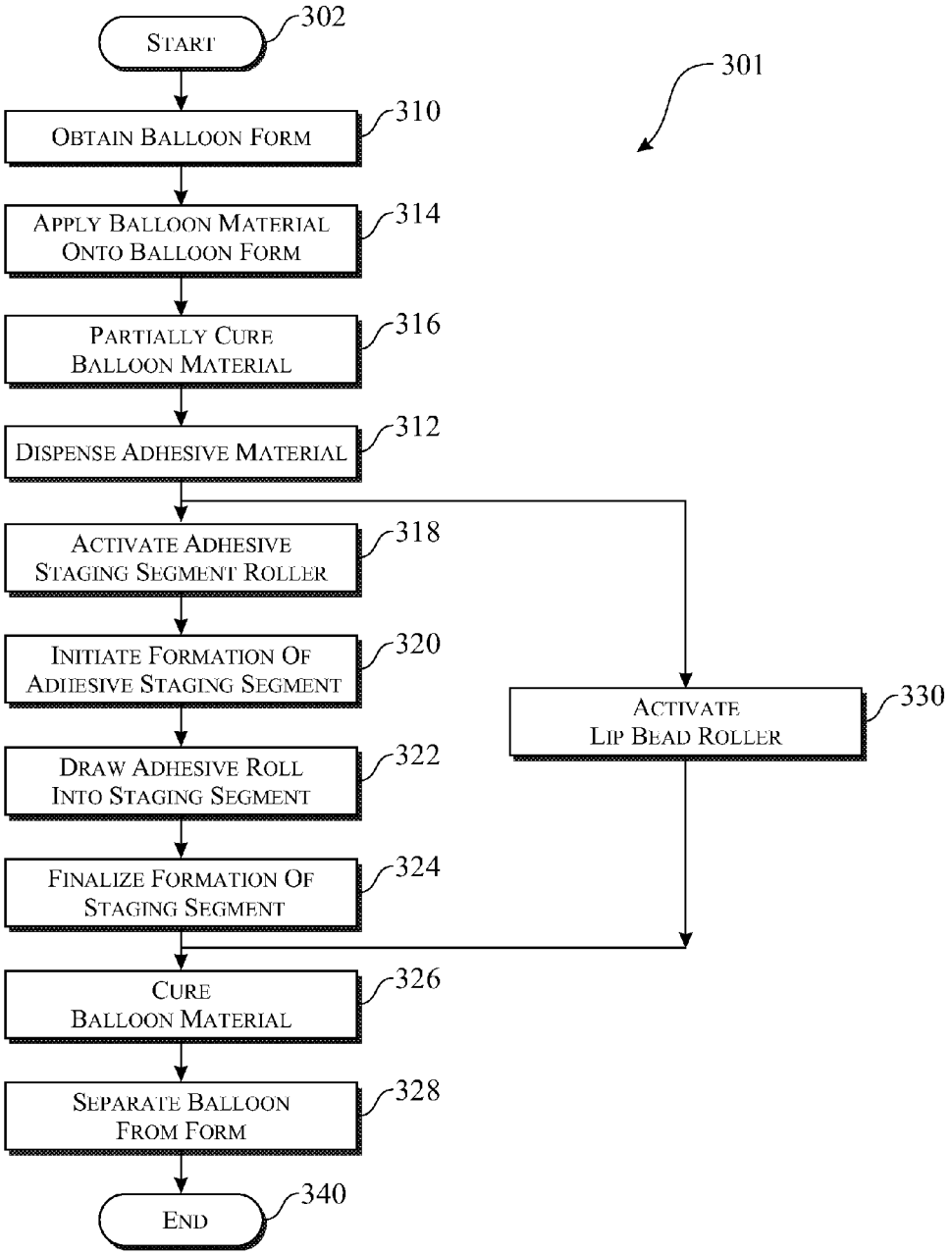
FIG. 14 presents a flow diagram detailing a second exemplary balloon fabrication process.

The self sealing balloon 200 can be fabricated in accordance with a variety of processes, including a first exemplary self-sealing balloon fabrication flow diagram 300 presented in FIG. 13 and a second exemplary self-sealing balloon fabrication flow diagram 301 presented in FIG. 14. The first exemplary self-sealing balloon fabrication flow diagram 300 initiates at a start step (block 302). A quick seal balloon fabrication form 100 is obtained in accordance with an obtain balloon form step 310. The quick seal balloon fabrication form 100 can be assembled to an automated device for automating the self-sealing balloon fabrication process. Adhesive material is dispensed into the adhesive dispensing segment 150 (block 312). The adhesive material can be dispensed from a remotely located adhesive material reservoir by a pump, a positive pressure displacement system, and the like. An optional, removable form can be placed about the adhesive dispensing segment 150 to aid in shaping the adhesive material into a dispensed adhesive roll 170. In the first exemplary self-sealing balloon fabrication flow diagram 300, balloon material is applied to the balloon form member 120 (block 314). The balloon material can be applied to the balloon form member 120 using any suitable application process, including dipping, spray, brush, rolling, and the like. During the process, the applied balloon material is at least partially cured (block 316).

The first exemplary self-sealing balloon fabrication flow diagram 300 and second exemplary self-sealing balloon fabrication flow diagram 301 differ wherein in the first exemplary self-sealing balloon fabrication flow diagram 300, the step of dispensing the adhesive material upon the adhesive dispensing segment 150 (block 312) is accomplished prior to the step of applying the balloon material onto the balloon form member 120 (block 314) and in the second exemplary self-sealing balloon fabrication flow diagram 301, the step of dispensing the adhesive material upon the adhesive dispensing segment 150 (block 312) is accomplished subsequent to the step of applying the balloon material onto the balloon form member 120 (block 314) and preferably after the balloon material is at least partially cured (block 316). In the second exemplary self-sealing balloon fabrication flow diagram 301, the balloon material can act as the optional, removable form.

The dispensed adhesive roll 170 is encased within an adhesive staging segment 172 by at least one adhesive staging segment roller 190 (blocks 318 through 324). The encasing process initiates by activating the at least one adhesive staging segment roller 190 (block 318). The at least one adhesive staging segment roller 190 frictionally engages with the exterior surface of the tubular balloon neck segment 220 to begin stretching the material to form the adhesive staging segment 172 (block 320). The at least one adhesive staging segment roller 190 continues to draw the section of the tubular balloon neck segment 220, where the interior surface of the tubular balloon neck segment 220 grips the dispensed adhesive roll 170 and draws the dispensed adhesive roll 170 into the adhesive staging segment 172 (block 322). The forming process continues until the adhesive staging segment 172 is formed into the desired shape, finalizing the formation of the adhesive staging segment 172 (block 324).

At any suitable point during the process, at least one lip bead roller 192 is activated and proceeds in forming a lip bead 224 at the balloon unfinished edge 222 of the tubular balloon neck segment 220 (block 330). It is understood that any known process can be utilized to form the lip bead 224.

If the balloon material is not yet cured, the process finalizes the curing of the balloon material (block 326). The self sealing balloon 200 is removed from the balloon form member 120 using any suitable separation process (block 328). At any suitable point in the process, an image can be applied to an exterior surface of the self sealing balloon 200. This image can be printed thereon, sprayed thereon, and the like. The self sealing balloon 200 can be fabricated of a single colored balloon material, a balloon material comprising a swirl of multiple colors, dipped at different levels into different vats of balloon material, each vat comprising a different balloon material color, and the like to create unique balloons 200. The self sealing balloon 200 may be tested to ensure against defects prior to packaging and shipping to a distributor, retailer, and the like, thus terminating the process (block 340).

Figure 15:
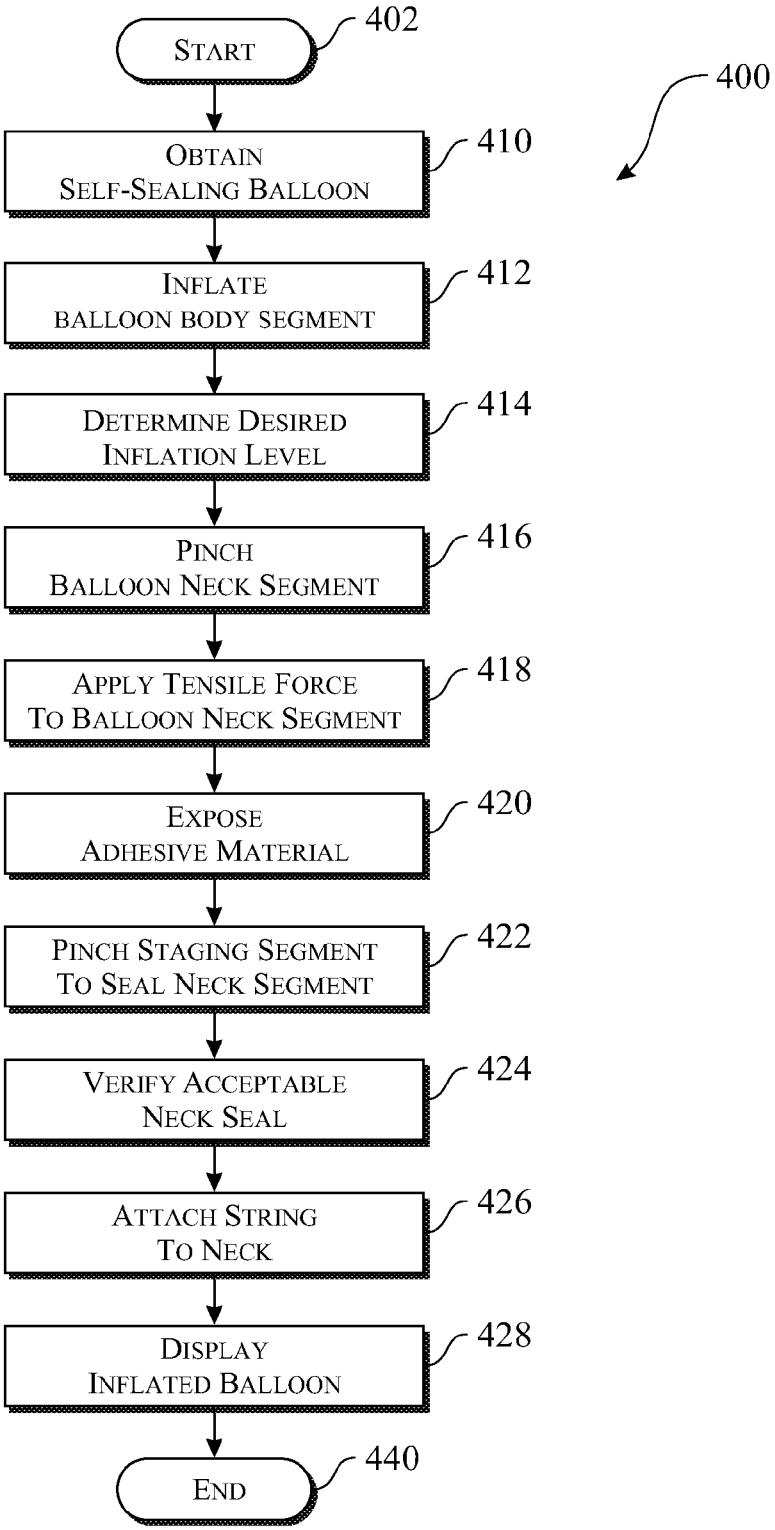
FIG. 15 presents a flow diagram detailing an exemplary balloon fill and sealing process.

The self sealing balloon 200 can be inflated in accordance with a variety of processes, with an exemplary self-sealing balloon inflation flow diagram 400 being presented in FIG. 15. The self-sealing balloon inflation flow diagram 400 initiates at a start step (block 402). A self sealing balloon 200 is obtained in accordance with an obtain a self-sealing balloon step 410. The balloon gas retaining expansion cavity 210 is inflated by passing pressurized inflating air 230 through the tubular balloon neck segment 220, causing the balloon gas retaining expansion cavity 210 to expand (block 412). The inflation step continues until the balloon gas retaining expansion cavity 210 is inflated to a desired fill level (block 414). The maximum inflation is commonly identified when the tubular balloon neck segment 220 begins to expand. When the balloon gas retaining expansion cavity 210 reaches the desired inflation level, the tubular balloon neck segment 220 is pinched to retain the entrapped air 232 therein (block 416). An adhesive exposing tensile force 176 is applied to the tubular balloon neck segment 220 in a direction parallel with the longitudinal axis thereof. (block 418). The adhesive exposing tensile force 176 unrolls the adhesive staging segment 172, exposing the dispensed adhesive roll 170 (block 420). A compression force or an adhesive bonding force 178 is applied to the area containing the exposed dispensed adhesive roll 170 to seal the tubular balloon neck segment 220 (block 422). The seal is inspected to determine if the seal is adequately retaining the entrapped air 232 within the balloon gas retaining expansion cavity 210 and a sealed, air entrapped neck segment 221 of the tubular balloon neck segment 220 (block 424). A thin, balloon supporting material, such as a string, a ribbon, and the like can be attached to the tubular balloon neck segment 220 of the self sealing balloon 200 (block 426). The thin, balloon supporting material is particularly useful for mooring balloons 200 that are filled with lighter than air gases, such as helium. The self sealing balloon 200 or multiple balloons 200 are displayed in accordance with the desired presentation (block 428), thus terminating the process (block 440).

Figure 16:
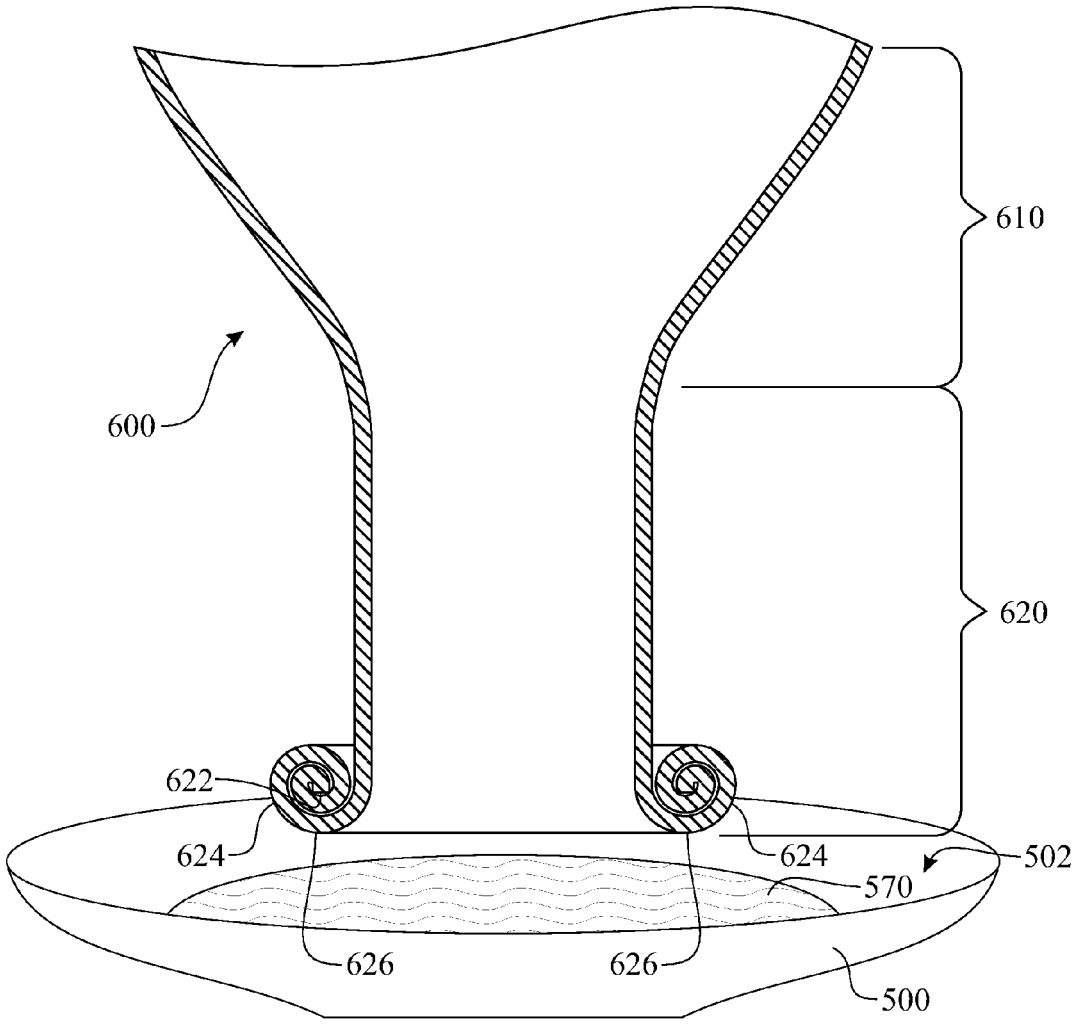
FIG. 16 presents a cross sectional elevation view of a neck section of an exemplary balloon prepared for a step of applying an adhesive bead to an exposed surface of a balloon lip bead.
Figure 17:
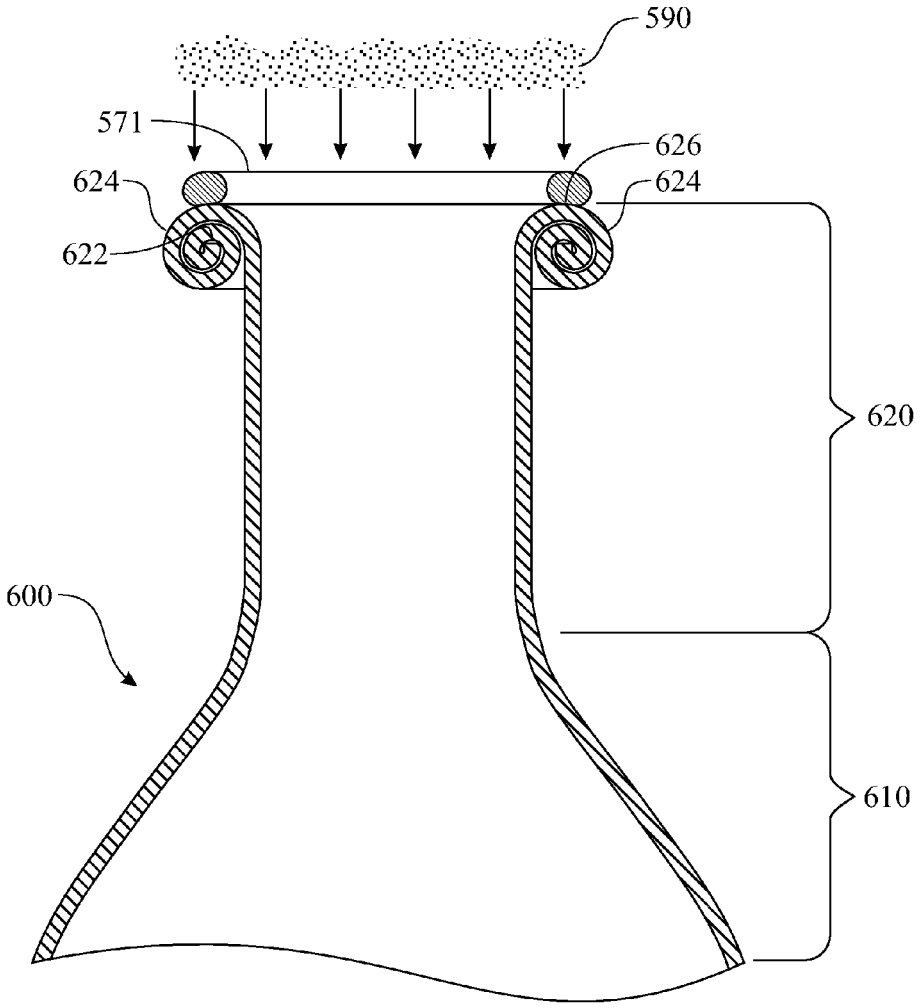
FIG. 17 presents a cross sectional elevation view of the neck section of the exemplary balloon subsequent to the preparation step presented in FIG. 16, wherein a protective talc power is being applied to the adhesive bead.
Figure 18:
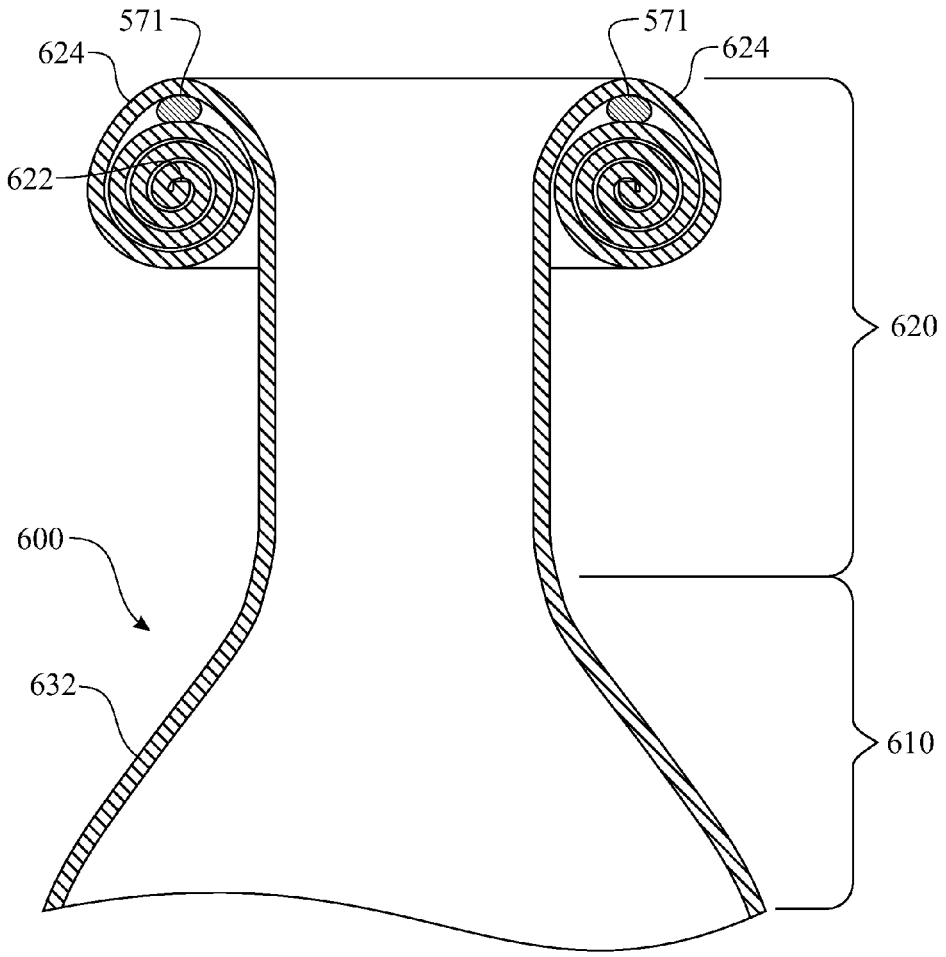
FIG. 18 presents a cross sectional elevation view of the neck section of the exemplary balloon having the adhesive bead rolled into the balloon lip bead.

The previously described balloon forming processes utilize a custom balloon form member 120 to fabricate the self sealing balloon 200. A self-sealing balloon 600, as illustrated in FIGS. 16 through 18, introduces an alternative embodiment for applying and encapsulating a moldable adhesive composition bead 571. The moldable adhesive composition bead 571 is created from a moldable adhesive composition 570 placed into an adhesive composition containing surface 502 of an adhesive composition presentation container 500. The self-sealing balloon 600 is similar to the self sealing balloon 200, with like elements of the self-sealing balloon 600 being numbered in a similar manner as the self-sealing balloon 600, with a prefix of the numeral "6". A lip bead adhesive receiving surface 626 of the lip bead 624 is inserted into the moldable adhesive composition 570 standing within the adhesive composition containing surface 502 of the adhesive composition presentation container 500. The moldable adhesive composition bead 571 is formed and adhered to the lip bead adhesive receiving surface 626 by adhesive properties of the moldable adhesive composition 570. An adhesive coating powder 590 can be applied to the exposed surface of the moldable adhesive composition bead 571 to aid in controlling undesired adhesion between the moldable adhesive composition bead 571 and the surface of the lip bead 624. Following the application of the adhesive coating powder 590 onto the moldable adhesive composition bead 571, the end of the lip of the self-sealing balloon 600 is rolled further encapsulating the moldable adhesive composition bead 571 within the lip bead 624, as illustrated in FIG. 18. The adhesive coating powder 590 aids in controlling a limited adhesion between the moldable adhesive composition bead 571 and the interior surface of the lip bead 624. In use, the self-sealing balloon 600 would be inflated, the tubular balloon neck segment 620 would be stretched and the lip bead 624 would be partially unrolled, exposing the moldable adhesive composition bead 571. The exposed moldable adhesive composition bead 571 would be compressed against itself, creating a gaseous seal. The moldable adhesive composition bead 571 would be of a formable material, enabling a simple sealing step compared to a tape adhesive, which could generate a leak if not bonded in a planar manner.

Figure 19:
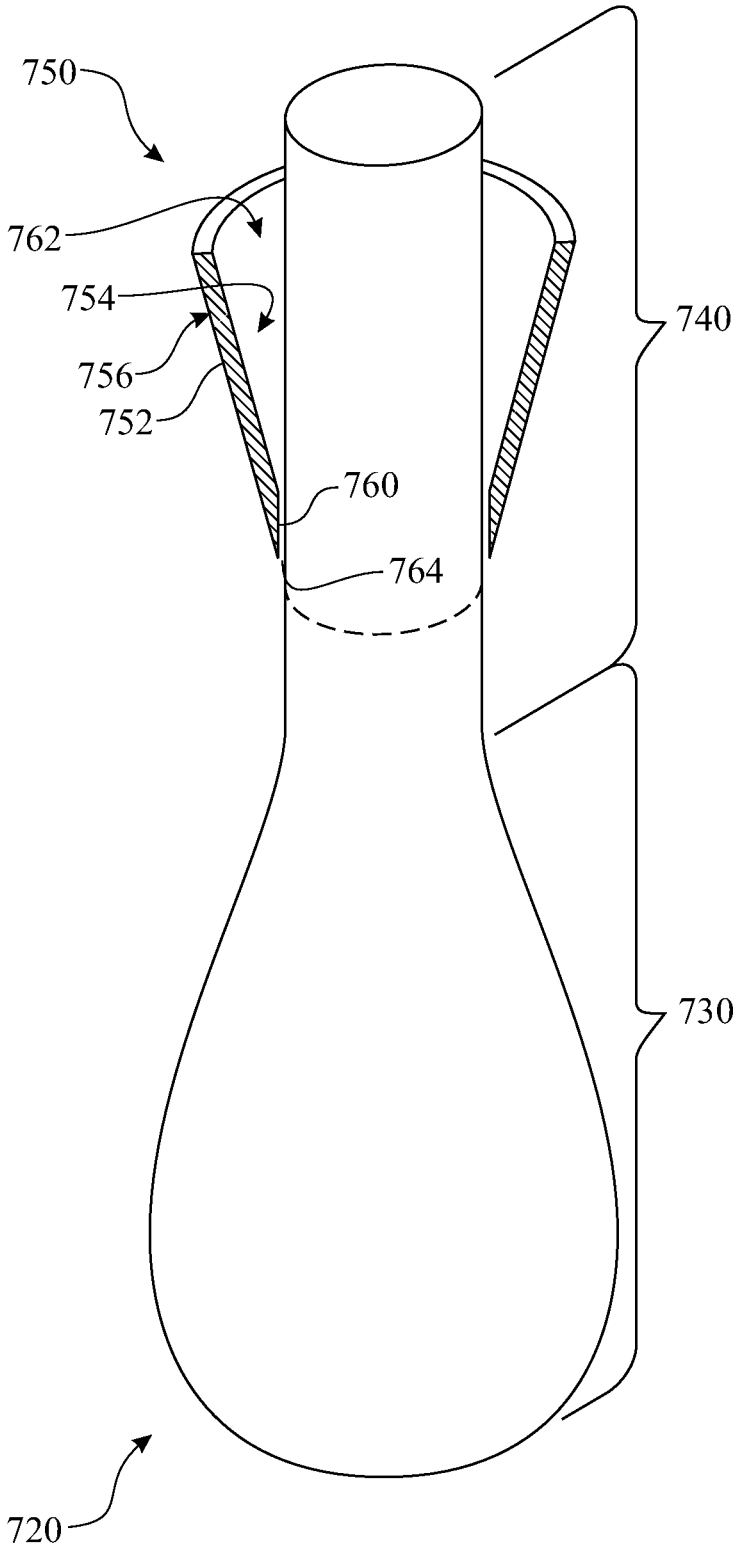
FIG. 19 presents a partial cross sectional elevation view of a balloon form introducing an adhesive dispensing adapter positioned thereabout.

Each balloon form member 120 requires a custom design, wherein the design is directed towards a fabrication of the self sealing balloon 200 by including the adhesive dispensing segment 150. A first variant is presented in FIGS. 19 through 21, wherein the adhesive dispensing segment 150 is replaced by an adhesive dispensing adapter 750 adapted to a balloon form member 720. The balloon form member 720 is segmented into a balloon body bulb shaped mold segment 730 and a balloon neck mold segment 740. The balloon form member 720 is representative of a currently fabricated balloon form, exclusive of the self sealing adhesive applicator, wherein the adhesive dispensing adapter 750 is adapted to the balloon form member 720, converting the balloon form member 720 a tool for manufacturing commercially available, standard tie-seal balloon to a tool capable of manufacturing a self-sealing balloon. This reduces the costs of converting existing tooling throughout an established balloon fabrication factory. The adhesive dispensing adapter 750 includes a frustum shaped adapter body 752 having an adhesive adapter interior surface 754 facing a surface of the balloon form member 720 defining an adhesive storage volumetric space 762 and an adhesive adapter exterior surface 756 providing a forming surface used in a fabrication process of forming a self-sealing balloon 800. The self-sealing balloon 800 is similar to the self sealing balloon 200, 600 with like elements of the self-sealing balloon 800 being numbered in a similar manner as the self-sealing balloon 200, 600, with a prefix of the numeral "8". An adhesive dispensing edge 760 is formed at a lower edge of the adhesive dispensing adapter 750, wherein the adhesive dispensing edge 760 has a diameter that is preferably slightly greater than a diameter of an adjacent section of the balloon neck mold segment 740 forming an adhesive dispensing passageway 764 therebetween. The adhesive dispensing adapter 750 can be frustum shaped, cylindrical comprising a chamfered transitional edge where the adhesive dispensing adapter 750 meets the balloon form member 720, or any other suitable shape for forming the self-sealing balloon 800, while enabling passage of an moldable adhesive composition 770 through the adhesive storage volumetric space 762 and discharging through the adhesive dispensing passageway 764.

Figure 8:
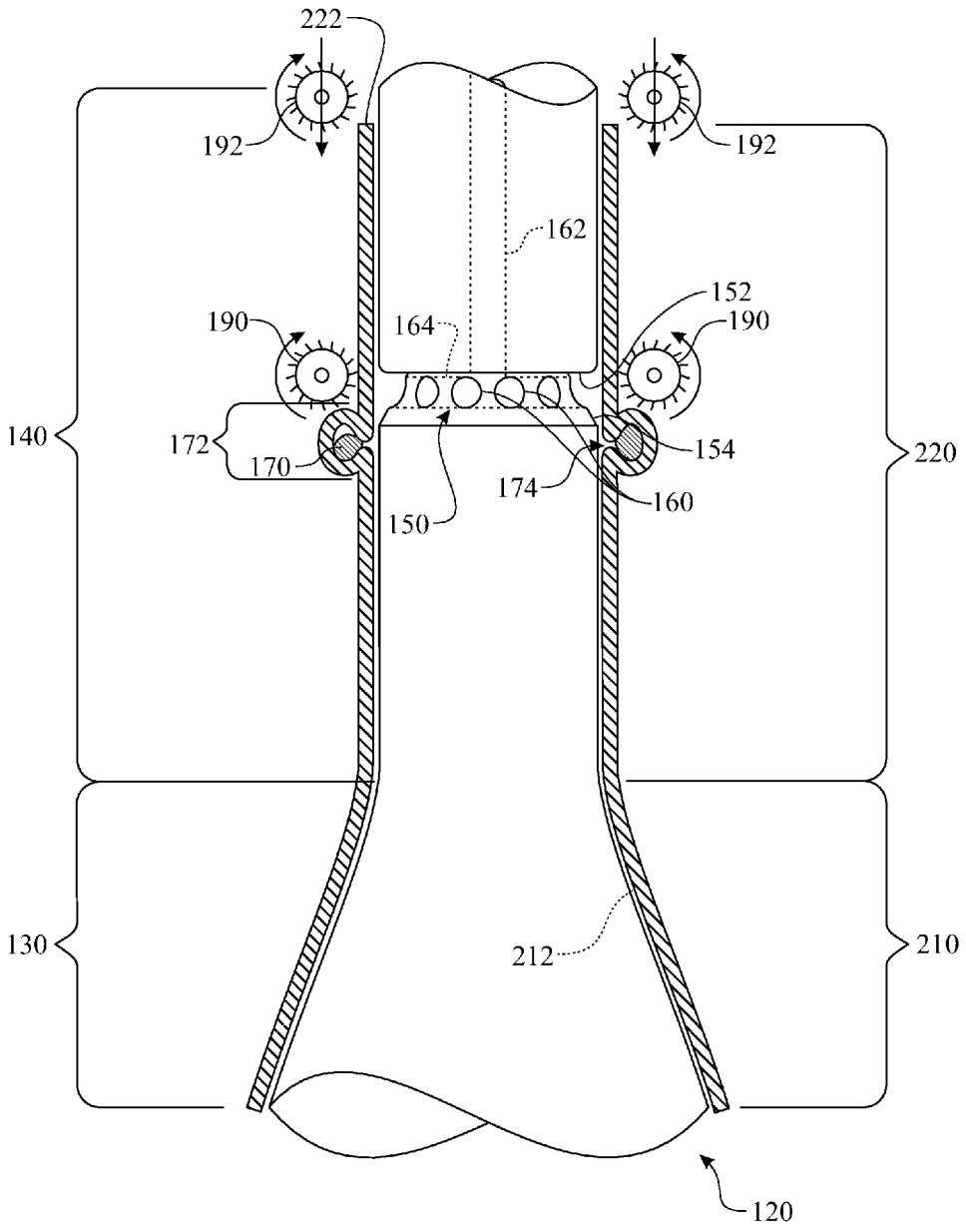
FIG. 8 presents a partially sectioned elevation view of the balloon neck mold segment illustrating an exemplary third step for forming an adhesive staging loop, wherein the third step completely encases the dispensed adhesive roll into the adhesive staging segment.
Figure 9:
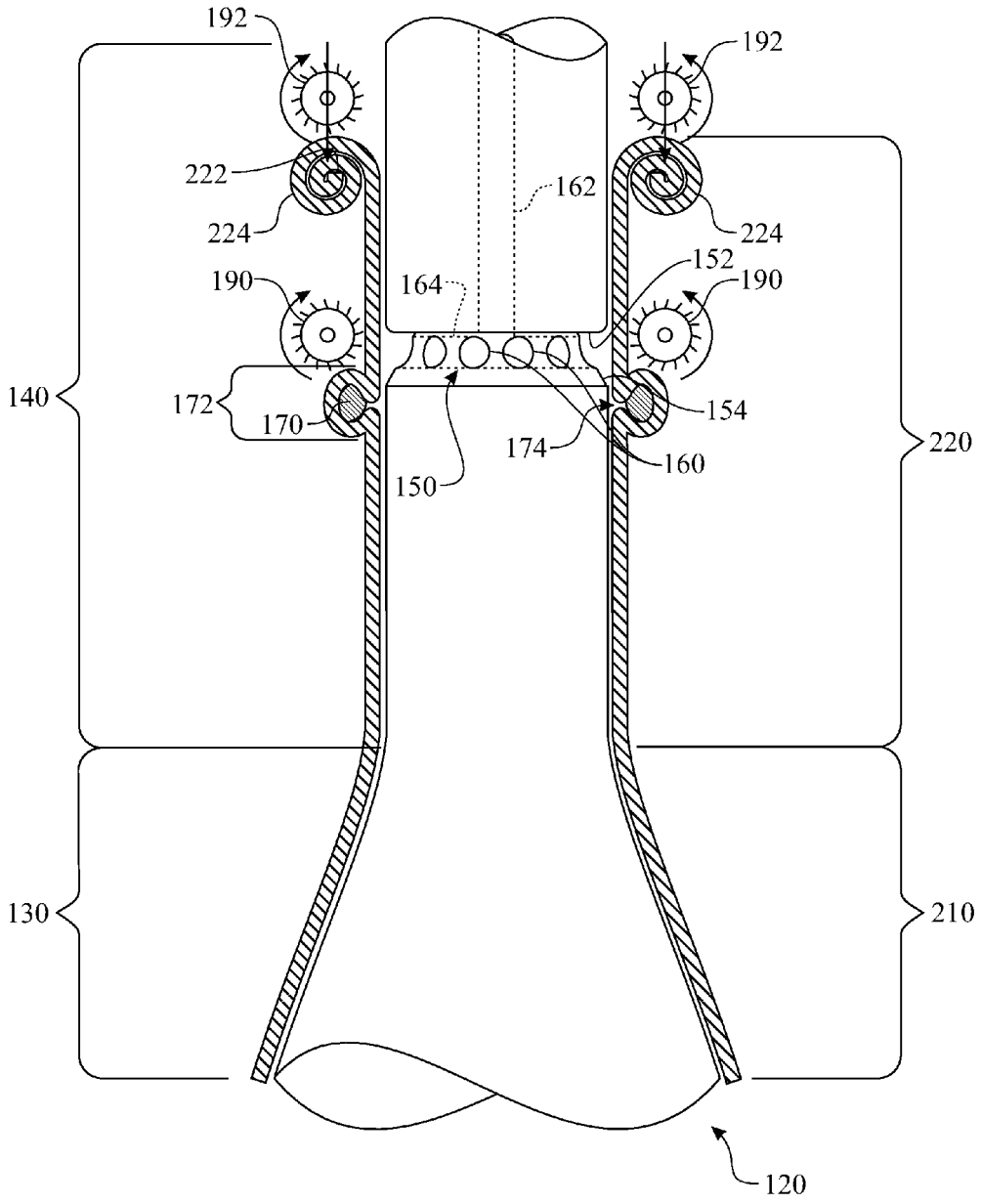
FIG. 9 presents a partially sectioned elevation view of the balloon neck mold segment illustrating an exemplary step of forming a lip bead.
Figure 20:
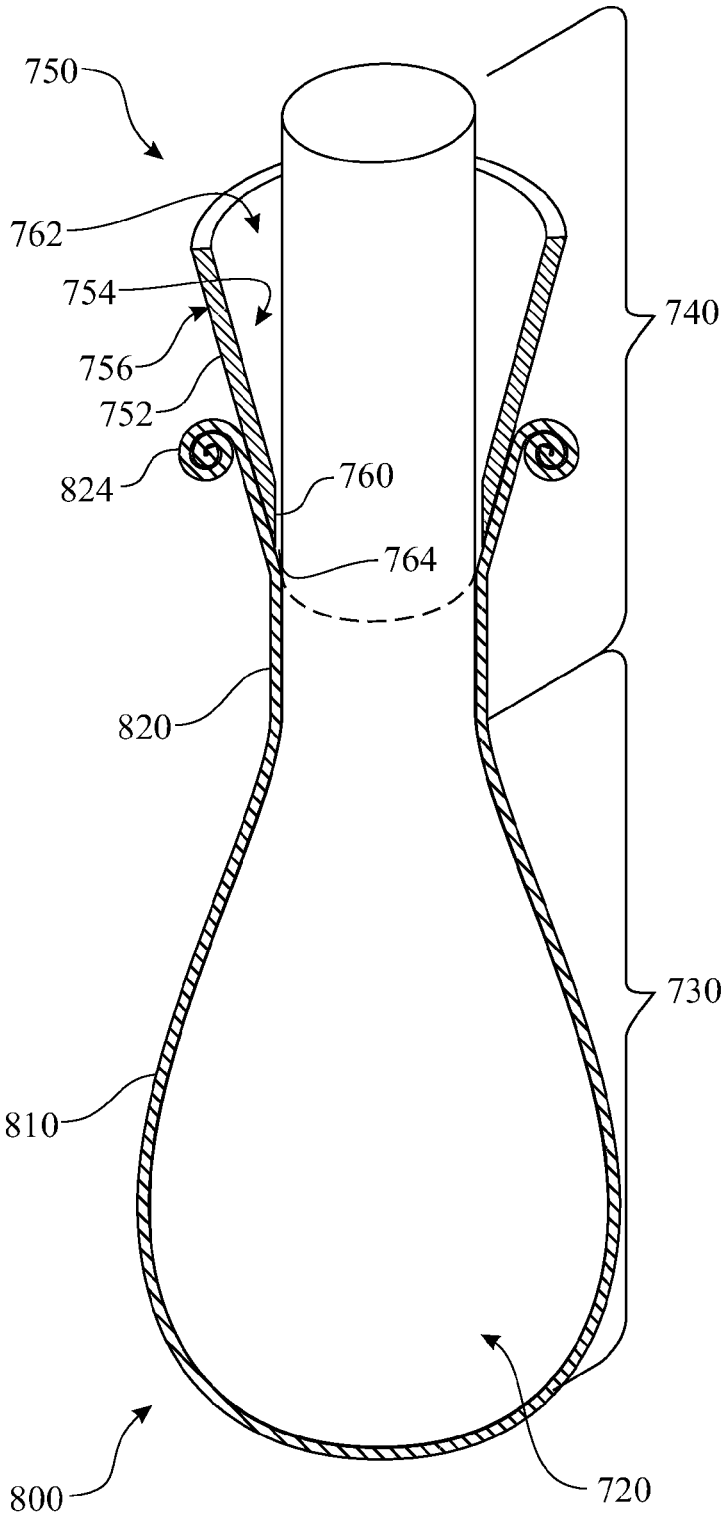
FIG. 20 presents a partial cross sectional elevation view of the balloon form introduced in FIG. 19, illustrating a self-sealing balloon in an initial forming step.
Figure 21:
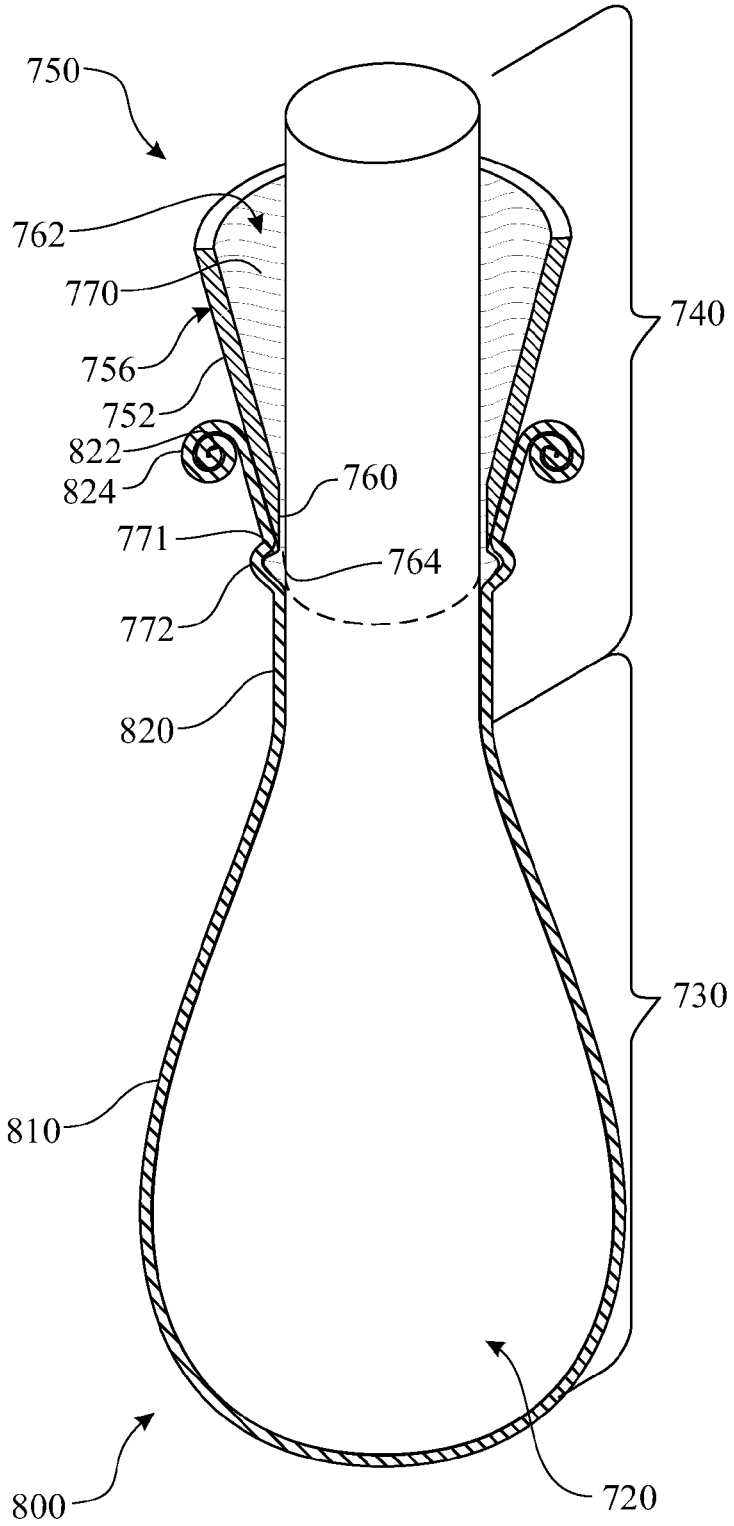
FIG. 21 presents a partial cross sectional elevation view of the balloon form introduced in FIG. 19, illustrating the self-sealing balloon in an adhesive dispensing step.

In practice, balloon forming material, such as latex, in liquid form, is applied to an exterior surface of the balloon form member 720 and the adhesive adapter exterior surface 756 as illustrated in FIG. 20. The balloon forming material is partially cured. A moldable adhesive composition 770 is dispensed into the adhesive storage volumetric space 762 and through the adhesive dispensing passageway 764 creating an applied moldable adhesive composition 771 as illustrated in FIG. 21. The applied moldable adhesive composition 771 displaces a section of the tubular balloon neck segment 820 forming an adhesive staging segment 772. The adhesive staging segment 772 is subsequently processed similar to the adhesive staging segment 172, as illustrated in FIG. 8. The advantage of the adhesive dispensing adapter 750 is the ability to fabricate the self-sealing balloon 800 while retaining the original balloon form member 720, thus avoiding significant retooling costs.

Figure 22:
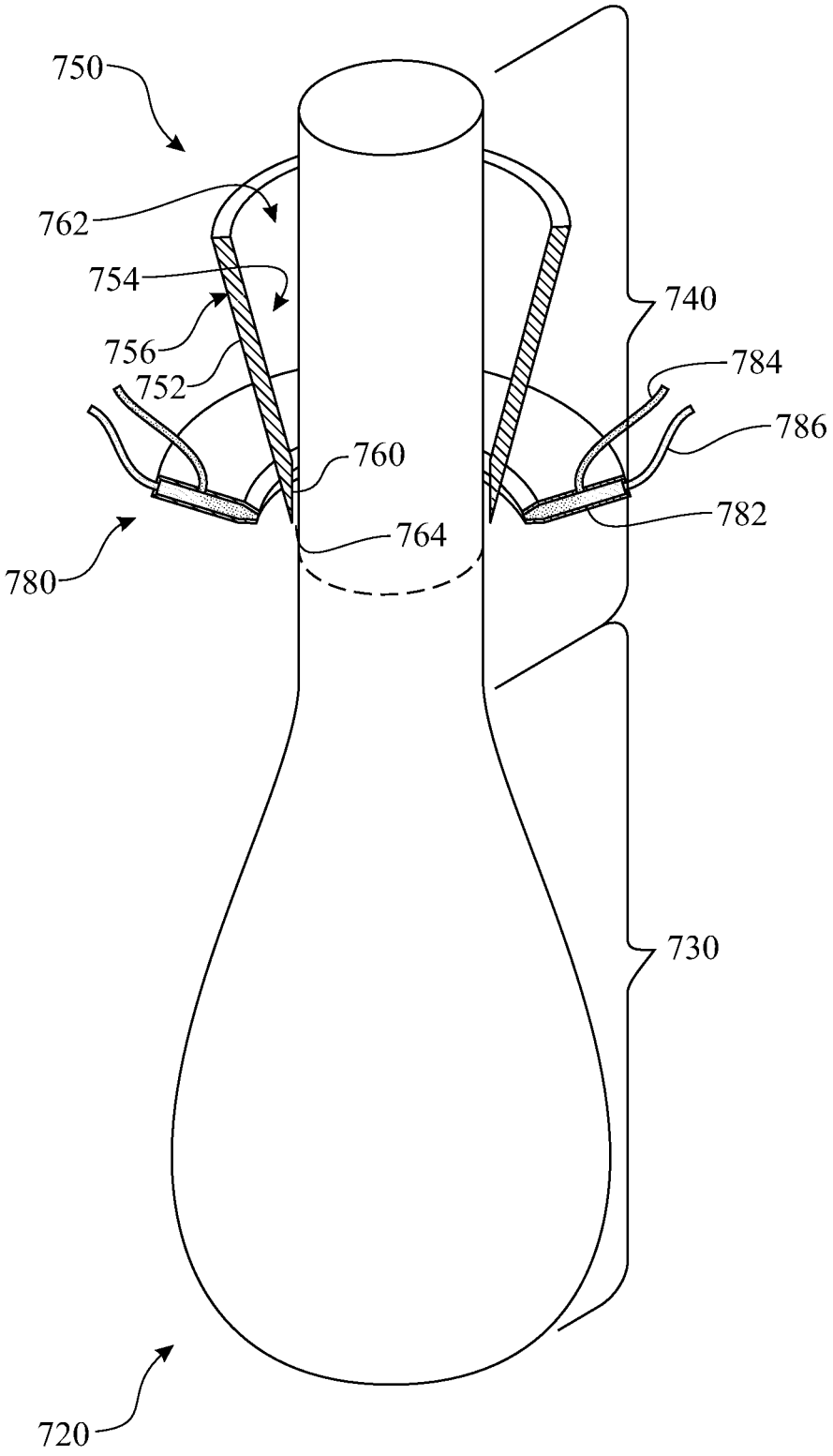
FIG. 22 presents a partial cross sectional elevation view of another exemplary balloon form comprising the same features as the balloon form presented in FIG. 19, introducing an exemplary power dispensing subsystem.
Figure 23:
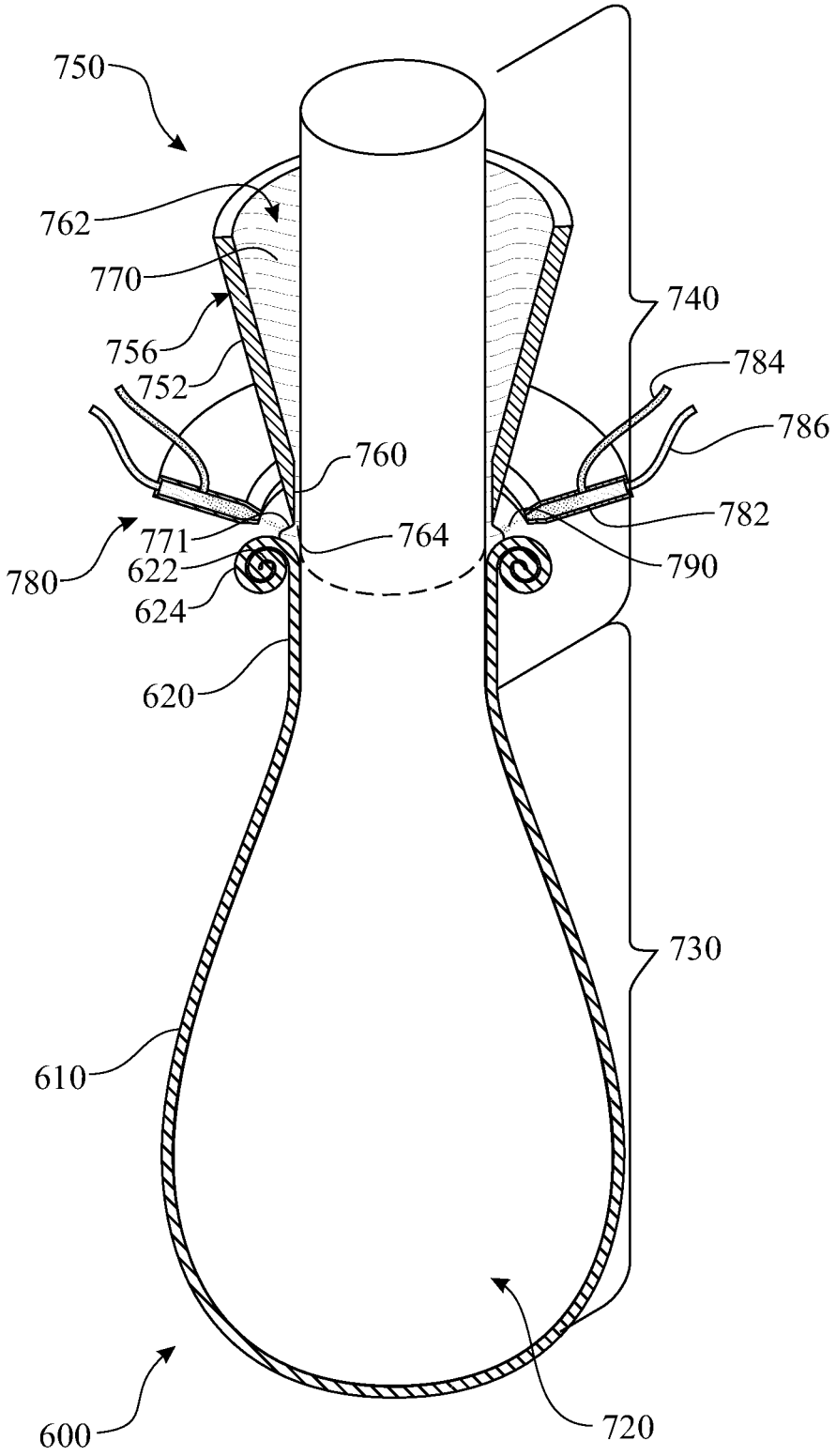
FIG. 23 presents a partial cross sectional elevation view of the balloon form introduced in FIG. 22, illustrating another exemplary self-sealing balloon in an adhesive dispensing and a powder application step.
Figure 24:
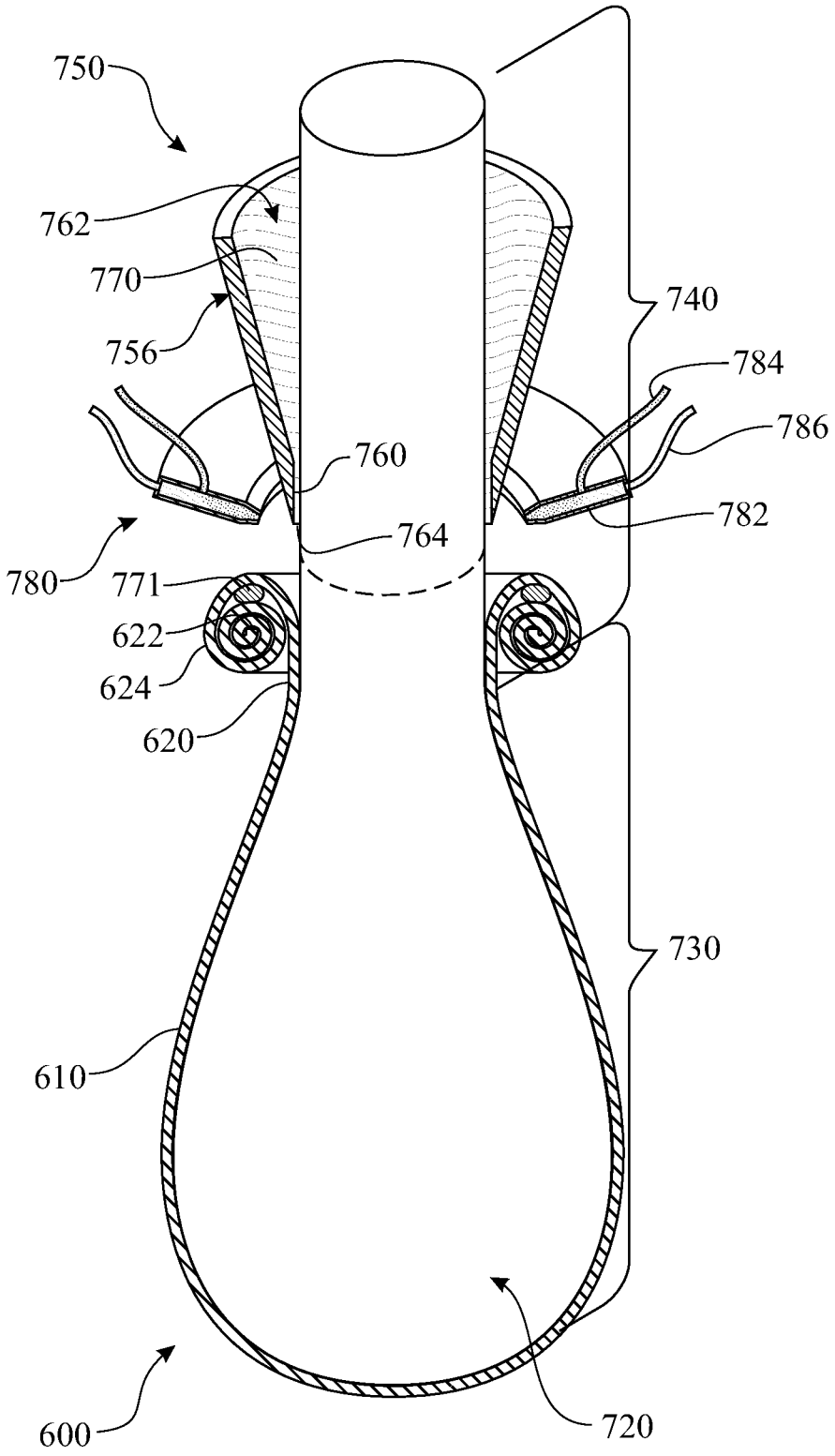
FIG. 24 presents a partial cross sectional elevation view of the balloon forming process introduced in FIG. 23, wherein the balloon lip bead is rolled encapsulating the dispensed adhesive.

The balloon fabrication process can be modified to introduce a powder applying subassembly 780 for application of a surface protecting powder 790 onto the applied moldable adhesive composition 771, as illustrated in FIGS. 22 through 24. The powder applying subassembly 780 is one exemplary system for dispensing the surface protecting powder 790 onto the applied moldable adhesive composition 771. The powder applying subassembly 780 comprises a powder applying mixing chamber 782 formed as a ring circumscribing the balloon neck mold segment 740 at a location proximate the adhesive dispensing passageway 764 and directed towards the applied moldable adhesive composition 771. The powder applying mixing chamber 782 is hollowed, creating a mixing chamber for combining the surface protecting powder 790 and flow of air or other propellant. The surface protecting powder 790 is sourced through a powder supply conduit 784. The flow of air or other propellant is sourced through a propellant supply conduit 786. As the air or other propellant flows through the hollowed interior of the powder applying mixing chamber 782, the air draws the surface protecting powder 790 into the hollowed interior of the powder applying mixing chamber 782 and propels the surface protecting powder 790 through a discharge port directed towards the applied moldable adhesive composition 771, as illustrated in FIG. 23. Like the adhesive dispensing adapter 750, the powder applying subassembly 780 is designed to be retrofitted onto the balloon form member 720. It is understood that the surface protecting powder 790 can be applied to the applied moldable adhesive composition 771 using any suitable system. The powder applying subassembly 780 would be designed to avoid any interference with the balloon dipping and forming process. The powder applying subassembly 780 can be segmented into two or more sections, enabling separation from the circumference of the balloon neck mold segment 740, providing unencumbered dipping of the balloon form member 720 into a vat of latex or other balloon forming material, then subsequently during a step of forming the lip bead 624.

Upon completion of the application of the surface protecting powder 790, the process would continue rolling the lip bead 624, entrapping the power coated applied moldable adhesive composition 771 therein as illustrated in FIG. 24.

Figure 25:
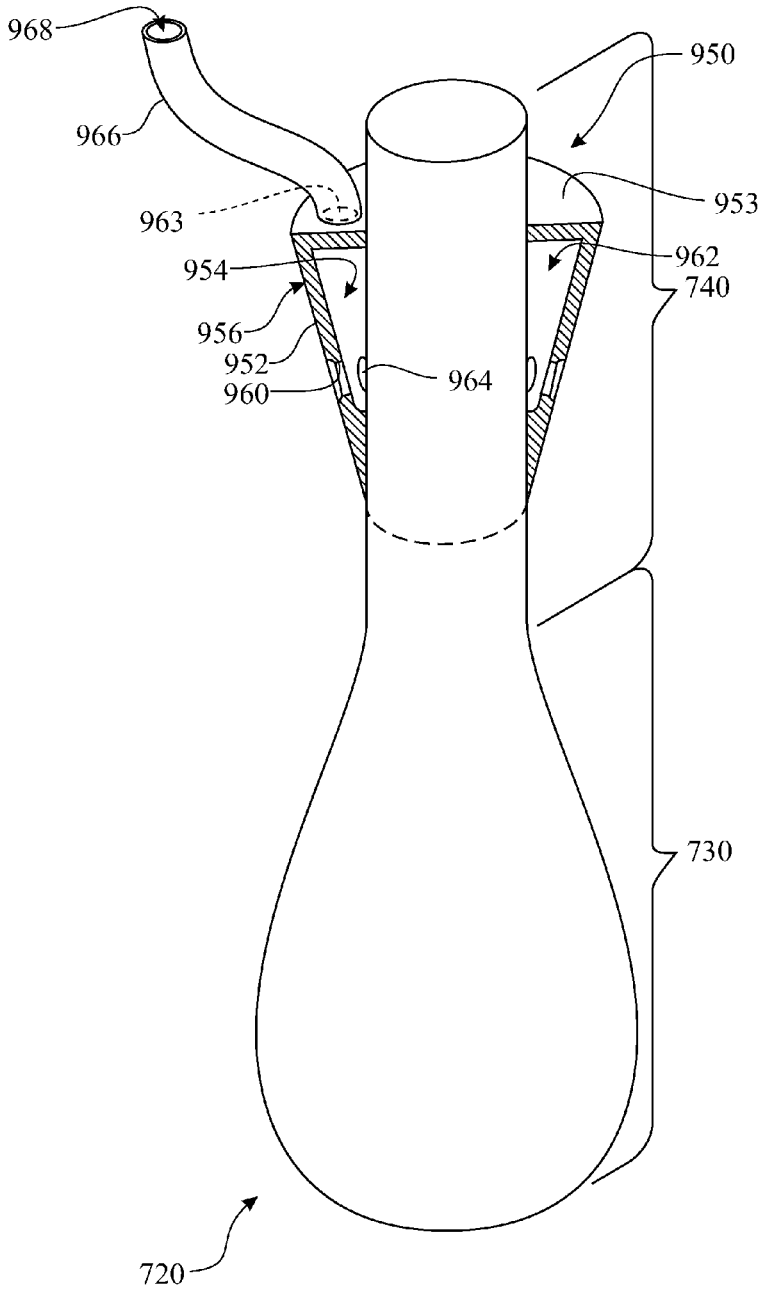
FIG. 25 presents a partial cross sectional elevation view of another exemplary balloon form comprising a variant of the adhesive dispensing subassembly introduced in FIG. 19, wherein the exemplary adhesive dispensing subassembly dispenses adhesive using applied pressure.
Figure 26:
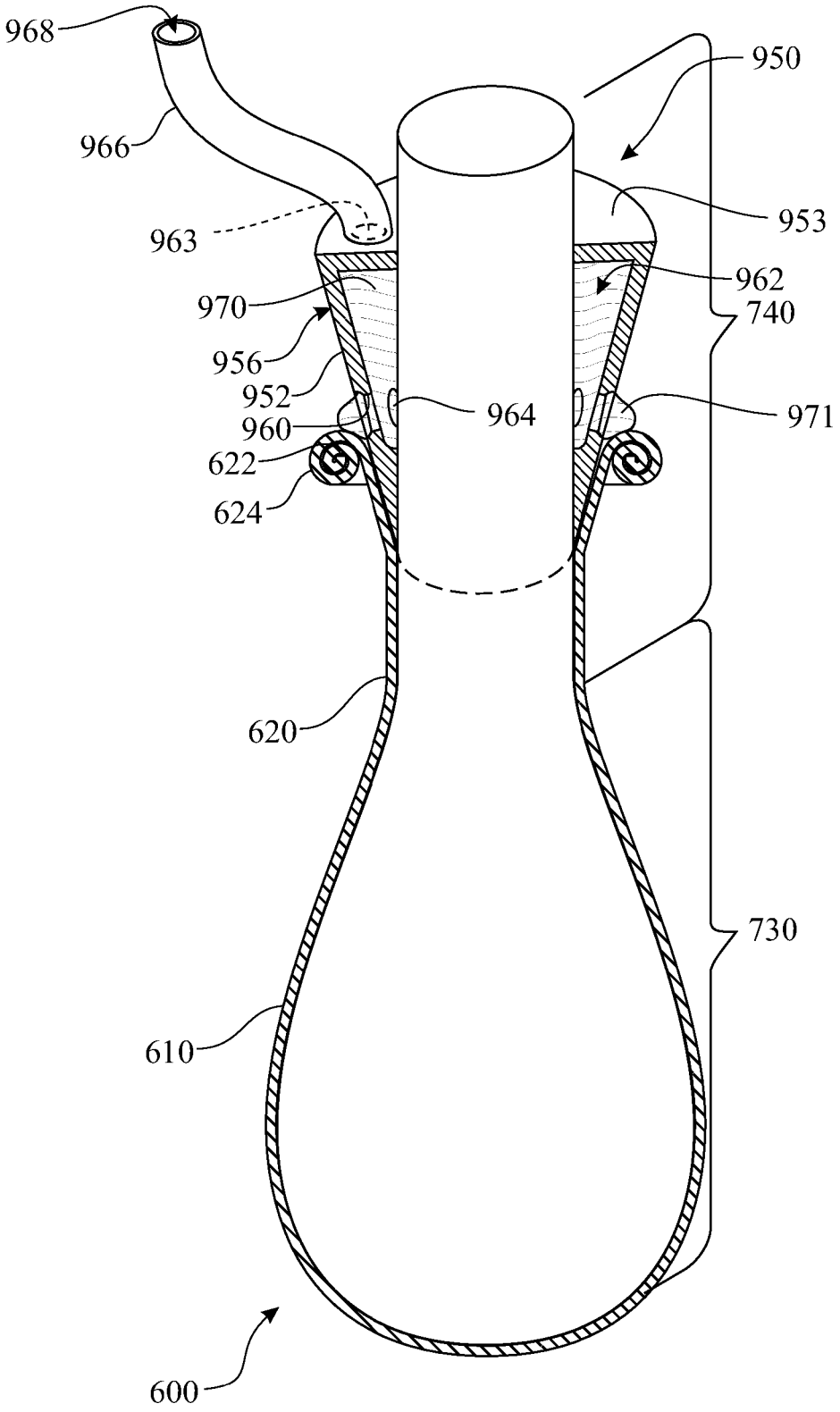
FIG. 26 presents a partial cross sectional elevation view of the balloon form introduced in FIG. 25, illustrating the exemplary self-sealing balloon in an alternative adhesive dispensing step.

Another variant of an adhesive applicator is an adhesive dispensing adapter 950, which is illustrated in FIGS. 25 and 26. The adhesive dispensing adapter 950 is a sealed, pressure operated variant of the adhesive dispensing adapter 750. The adhesive dispensing adapter 950 includes a frustum shaped adapter body 952 having an adhesive adapter interior surface 954 facing a surface of the balloon form member 720 defining an adhesive storage volumetric space 962 and an adhesive adapter exterior surface 956 providing a forming surface used in a fabrication process of forming the self-sealing balloon 600. A frustum shaped adapter body top panel 953 provides a seal across an upper edge of the frustum shaped adapter body 952 of the adhesive dispensing adapter 750. In the exemplary embodiment, a lower edge of the frustum shaped adapter body 952 of the adhesive dispensing adapter 950 seals against the exterior surface of the balloon form member 720. A volume of moldable adhesive composition 970 is fed into and/or disposed within the adhesive storage volumetric space 962. In the exemplary embodiment, the moldable adhesive composition 970 is dispensed through one or more adhesive dispensing passageways 964, each adhesive dispensing passageway 964 being defined by a respective adhesive dispensing orifice 960. The one or more adhesive dispensing passageways 964 are preferably located through the frustum shaped adapter body 952 of the adhesive dispensing adapter 950 proximate the lower edge. Like the adhesive dispensing adapter 750, the adhesive dispensing adapter 950 can be frustum shaped, cylindrical comprising a chamfered transitional edge where the adhesive dispensing adapter 950 meets the balloon form member 720, or any other suitable shape for forming the self-sealing balloon 600.

In use, a pressure would be applied to the adhesive storage volumetric space 962. The pressure into the adhesive storage volumetric space 962 can be provided by a flow of moldable adhesive composition 970, airflow, a piston, or any other suitable pressure forming source. In the exemplary embodiment, the moldable adhesive composition 970 is supplied to the adhesive storage volumetric space 962 through a propellant/adhesive supply conduit passageway 968 of a propellant/adhesive supply conduit 966. A supply line orifice 963 is formed through the frustum shaped adapter body top panel 953, providing fluid communication between the propellant/adhesive supply conduit passageway 968 and the adhesive storage volumetric space 962. The sourced moldable adhesive composition 970 provides the volume of material and the associated pressure for dispensing the moldable adhesive composition 970 to form the applied moldable adhesive composition 971. The formation of the applied moldable adhesive composition 971 would be controlled by the volume supplied through the propellant/adhesive supply conduit 966 and the time duration of the distribution (application of pressure). The process can optionally include the powder applying subassembly 780 for application of the surface protecting powder 790. Upon completion of the dispensing and formation of the applied moldable adhesive composition 771, the process would continue rolling the lip bead 624, entrapping the applied moldable adhesive composition 971 therein as illustrated in FIG. 24. The rolling process extrudes and distributes the applied moldable adhesive composition 971 evenly to accommodate any differences between adjacent adhesive dispensing orifices 960.

Figure 27:
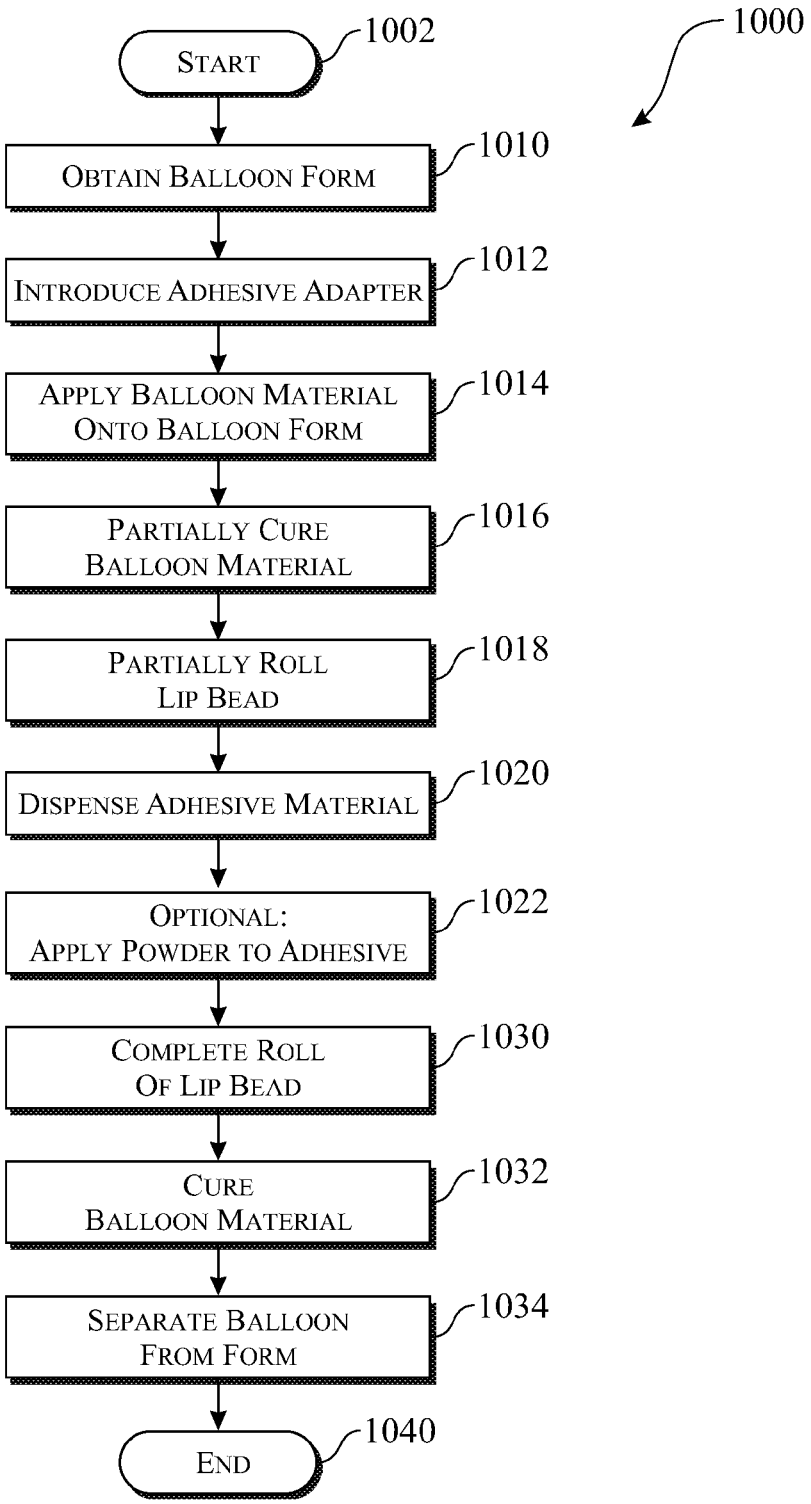
FIG. 27 presents a flow diagram detailing another exemplary balloon fabrication process.

The self sealing balloon 600 can be fabricated in accordance with a variety of processes, including a third exemplary self-sealing balloon fabrication flow diagram 1000 presented in FIG. 27. The third exemplary self-sealing balloon fabrication flow diagram 1000 initiates at a start step (block 1002). A balloon form member 720 is obtained in accordance with an obtain balloon form step 1010. The balloon form member 720 can be assembled to an automated device for automating the self-sealing balloon fabrication process. The adhesive dispensing adapter 750, 950, or a similar device is either preassembly or subsequently assembled to the balloon form member 720 in accordance with an introduction of the adhesive dispensing adapter 750, 950 step (block 1012). In the exemplary self-sealing balloon fabrication flow diagram 1000, balloon material is applied to the balloon form member 720, continuing up onto a lower portion of the adhesive dispensing adapter 750, 950 (block 1014). The balloon material can be applied to the balloon form member 720 and the adhesive dispensing adapter 750, 950 using any suitable application process, including dipping, spray, brush, rolling, and the like. During the process, the applied balloon material is at least partially cured (block 1016). The balloon forming process continues by partially rolling the balloon unfinished lip 622 along the tubular balloon neck segment 620 forming the lip bead 624. The rolling process would roll the lip bead 624 to a position proximate to, while exposing the adhesive dispensing passageway 764 as shown in FIG. 23 or below the series of adhesive dispensing orifice 960, as shown in FIG. 26.

Adhesive material is dispensed onto the lip bead adhesive receiving surface 626 by adhesive dispensing adapter 750, 950 (block 1020) as illustrated in FIGS. 23 and 26. The adhesive material can be supplied to the adhesive dispensing adapter 750, 950 from a remotely located adhesive material reservoir by a pump, a positive pressure displacement system, and the like. It is also understood that the process described herein is partially applicable to the dipping process described in FIGS. 16 through 18. The exemplary self-sealing balloon fabrication flow diagram 1000. An optional step of applying a powder 790, such as a talc powder, to the exposed surface of the applied moldable adhesive composition 771, 971 can be accomplished using the powder applying subassembly 780 or a similar powder dispensing system (block 1022). The surface protecting powder 790 manages adhesion between the applied moldable adhesive composition 771 and the surface of the self-sealing balloon 600, within the lip bead 624 (or alternatively within the adhesive staging segment 172 when the applied moldable adhesive composition 771 is entrapped therein). The process continues rolling the lip bead 624 in accordance with a completion of rolling the lip bead step (block 1030). It is understood that any known process can be utilized to form the lip bead 224. If the balloon material is not yet cured, the process finalizes the curing of the balloon material (block 1032). The self sealing balloon 200 is removed from the balloon form member 120 using any suitable separation process (block 1034). At any suitable point in the process, an image can be applied to an exterior surface of the self sealing balloon 600. This image can be printed thereon, sprayed thereon, and the like. The self sealing balloon 600 can be fabricated of a single colored balloon material, a balloon material comprising a swirl of multiple colors, dipped at different levels into different vats of balloon material, each vat comprising a different balloon material color, and the like to create unique balloons 600. The self sealing balloon 600 may be tested to ensure against defects prior to packaging and shipping to a distributor, retailer, and the like, thus terminating the process (block 1040).

Figure 28:
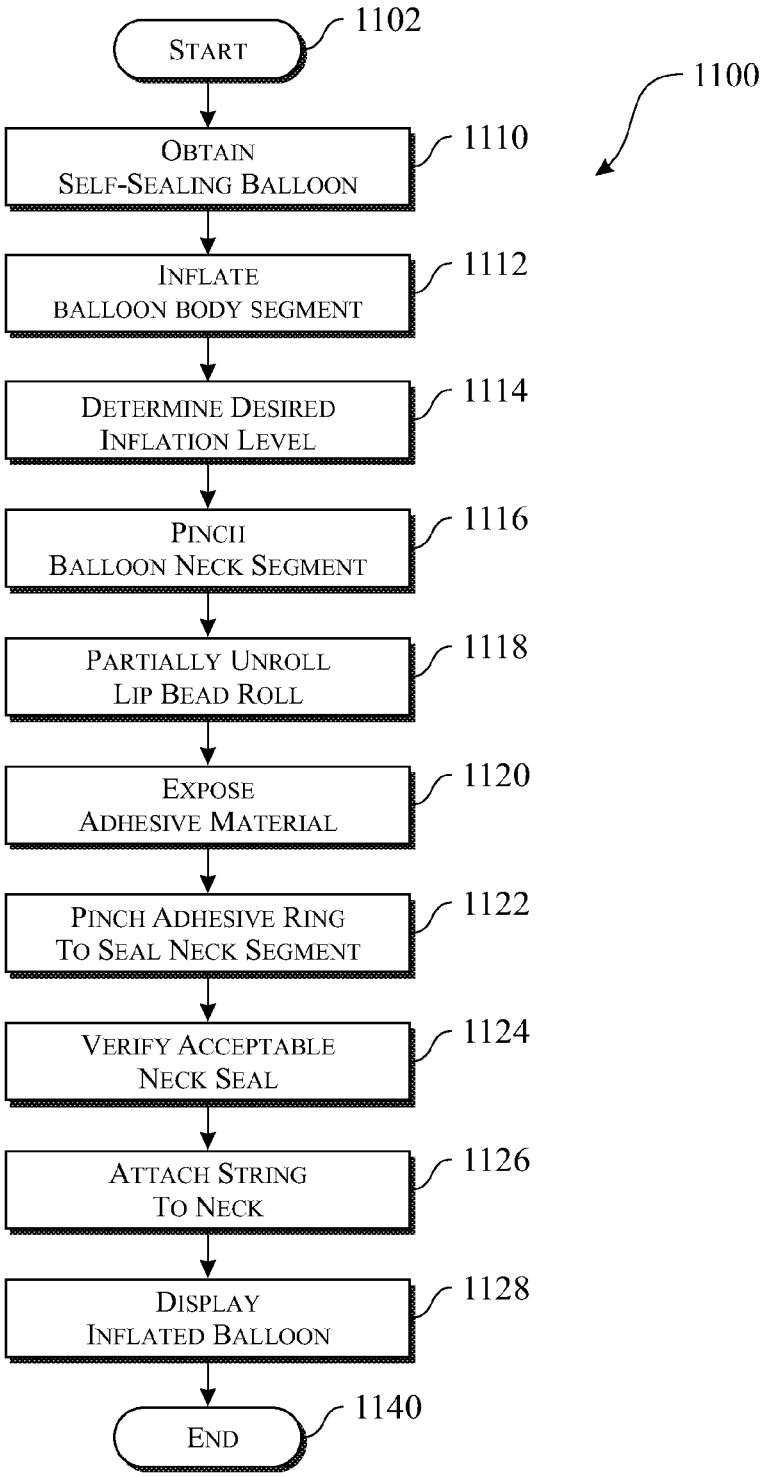
FIG. 28 presents a flow diagram detailing another exemplary balloon fill and sealing process.

The self sealing balloon 600 can be inflated in accordance with a variety of processes, with an exemplary self-sealing balloon inflation flow diagram 1100 being presented in FIG. 28. The self-sealing balloon inflation flow diagram 1100 initiates at a start step (block 1102). A self sealing balloon 600 is obtained in accordance with an obtain a self-sealing balloon step 1110. The balloon gas retaining expansion cavity 610 is inflated by passing pressurized inflating air through the tubular balloon neck segment 620, causing the balloon gas retaining expansion cavity 610 to expand (block 1112). The inflation step continues until the balloon gas retaining expansion cavity 610 is inflated to a desired fill level (block 1114). The maximum inflation is commonly identified when the tubular balloon neck segment 620 begins to expand. When the balloon gas retaining expansion cavity 610 reaches the desired inflation level, the tubular balloon neck segment 620 is pinched to retain entrapped air therein (block 1116). The lip bead 624 would then be unrolled (block 1118) until the applied moldable adhesive composition 771 is exposed (block 1120). The moldable adhesive ring would then be pinched or compressed together forming a gas impervious seal across the tubular balloon neck segment 620 (block 1122). The seal is inspected to determine if the seal is adequately retaining air entrapped within the balloon gas retaining expansion cavity 610 and a sealed, air entrapped neck segment of the tubular balloon neck segment 620 (block 1124). A thin, balloon supporting material, such as a string, a ribbon, and the like can be attached to the tubular balloon neck segment 620 of the self sealing balloon 600 (block 1126). The thin, balloon supporting material is particularly useful for mooring balloons 600 that are filled with lighter than air gases, such as helium. The self sealing balloon 600 or multiple self sealing balloons 600 are displayed in accordance with the desired presentation (block 1128), thus terminating the process (block 1140).

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

REFERENCE ELEMENT DESCRIPTIONS

Ref. No. Description

100 quick seal balloon fabrication form
110 fabrication manifold
112 fabrication manifold form surface
114 individual form transition member
120 balloon form member
130 balloon body bulb shaped mold segment
140 balloon neck mold segment
142 balloon neck mold segment longitudinal axis
150 adhesive dispensing segment
152 base adhesive control surface
154 angled adhesive control surface
160 adhesive dispensing aperture
162 adhesive primary delivery conduit
164 adhesive distribution delivery conduit
170 dispensed adhesive roll
172 adhesive staging segment
174 adhesive staging segment gap
176 adhesive exposing tensile force
178 adhesive bonding force
180 peripheral surface of said moldable adhesive cross sectioned profile
182 unfinished edge adhesive staging segment
184 expansion cavity adhesive staging segment
190 adhesive staging segment roller
192 lip bead roller
200 balloon
210 balloon gas retaining expansion cavity
212 balloon interior surface
220 tubular balloon neck segment
221 sealed, air entrapped neck segment
222 balloon unfinished lip
224 lip bead
226 lip bead adhesive receiving surface
229 tubular balloon neck unsealable length
230 pressurized inflating air
232 entrapped air
299 compressed air delivery nozzle
300 first exemplary self-sealing balloon fabrication flow diagram
301 second exemplary self-sealing balloon fabrication flow diagram
302 self sealing balloon forming process initiation step
310 obtain balloon form step
312 dispense balloon sealing adhesive step
314 apply balloon material onto balloon form step
316 partially cure balloon material step
318 activate adhesive staging segment roller step
320 initiate formation of adhesive staging segment step
322 draw adhesive roll into adhesive staging segment step
324 finalizing formation of adhesive staging segment step
326 cure balloon material
328 separate balloon from balloon form step
330 activate lip bead roller step
340 self sealing balloon forming process termination step
400 self-sealing balloon inflation flow diagram
402 self sealing balloon inflation process initiation step
410 obtain self sealing balloon step
412 inflate balloon body segment step
414 determine desired inflation level step
416 pinch balloon neck segment step
418 apply tensile force to balloon neck segment step

420 expose adhesive material step
422 pinch adhesive staging segment to seal neck segment step
424 verify acceptable neck seal has been achieved step
426 attach string to neck step
428 display inflated balloon step
440 self sealing balloon inflation process termination step
500 adhesive composition presentation container
502 adhesive composition containing surface
570 moldable adhesive composition
571 moldable adhesive composition bead
590 adhesive coating powder
600 self-sealing balloon
610 balloon gas retaining expansion cavity
620 tubular balloon neck segment
622 balloon unfinished lip
624 lip bead
626 lip bead adhesive receiving surface
720 balloon form member
730 balloon body bulb shaped mold segment
740 balloon neck mold segment
750 adhesive dispensing adapter
752 frustum shaped adapter body
754 adhesive adapter interior surface
756 adhesive adapter exterior surface
760 adhesive dispensing edge
762 adhesive storage volumetric space
764 adhesive dispensing passageway
770 moldable adhesive composition
771 applied moldable adhesive composition
772 adhesive staging segment
780 powder applying subassembly
782 powder applying mixing chamber
784 powder supply conduit
786 propellant supply conduit
790 surface protecting powder
800 self-sealing balloon
810 balloon gas retaining expansion cavity
820 tubular balloon neck segment
822 balloon unfinished lip
824 lip bead
950 adhesive dispensing adapter
952 frustum shaped adapter body
953 frustum shaped adapter body top panel
954 adhesive adapter interior surface
956 adhesive adapter exterior surface
960 adhesive dispensing orifice
962 adhesive storage volumetric space
963 supply line orifice
964 adhesive dispensing passageway
966 propellant/adhesive supply conduit
968 propellant/adhesive supply conduit passageway
970 moldable adhesive composition
971 applied moldable adhesive composition
1000 third exemplary self-sealing balloon fabrication flow diagram
1002 self sealing balloon forming process initiation step
1010 obtain balloon form step
1012 introduce adhesive adapter to balloon form step
1014 apply balloon material onto balloon form step
1016 partially cure balloon material step
1018 partially roll lip bead step
1020 dispense balloon sealing adhesive step
1022 optionally apply powder to exposed surface of adhesive step
1030 complete roll lip bead step
1032 cure balloon material
1034 separate balloon from balloon form step
1040 self sealing balloon forming process termination step
1100 self-sealing balloon inflation flow diagram
1102 self sealing balloon inflation process initiation step
1110 obtain self sealing balloon step
1112 inflate balloon body segment step
1114 determine desired inflation level step
1116 pinch balloon neck segment step
1118 partially unroll lip bead roll step
1120 expose adhesive material step
1122 pinch exposed moldable adhesive ring to seal neck segment step
1124 verify acceptable neck seal has been achieved step
1126 attach string to neck step
1128 display inflated balloon step
1140 self sealing balloon inflation process termination step

What is claimed is:

1. A self sealing balloon assembly comprising:

a balloon having a tubular balloon neck segment extending in fluid communication between a balloon unfinished edge and a balloon gas retaining expansion cavity;

a moldable adhesive ring carried by an interior surface of the said tubular balloon neck segment, said moldable adhesive ring having a moldable adhesive cross sectioned profile formed into a ring shape, said moldable adhesive ring circumscribing a circumference said interior surface of a fraction of a length of said tubular balloon neck segment; and a section of said tubular balloon neck segment positioned about said moldable adhesive cross sectioned profile, wherein said section of said tubular balloon neck segment substantially encases said moldable adhesive ring within a section of said tubular balloon neck segment of said balloon to ensure one area of said moldable adhesive ring and a second area of said moldable adhesive ring do not join with one another until desired by a user.

2. A self sealing balloon assembly as recited in claim 1, wherein said section of said tubular balloon neck segment covering said moldable adhesive ring is rolled about an exterior surface of said tubular balloon neck segment, forming a lip bead.

3. A self sealing balloon assembly as recited in claim 1, wherein said moldable adhesive ring is covered by an interior surface of said tubular balloon neck segment.

4. A self sealing balloon assembly as recited in claim 1, wherein said section of said tubular balloon neck segment covering said moldable adhesive ring straddles said moldable adhesive ring defining a bead-sided sub-section of said tubular balloon neck segment and a body-sided sub-section of said tubular balloon neck segment, wherein said bead-sided sub-section of said tubular balloon neck segment and said body-sided sub-section of said tubular balloon neck segment collectively covers at least a substantial surface of said moldable adhesive cross sectioned profile.

5. A self sealing balloon assembly as recited in claim 1, wherein said moldable adhesive ring is located proximate a midpoint of said section of said tubular balloon neck segment covering said moldable adhesive ring defining a bead-sided sub-section of said tubular balloon neck segment and a body-sided sub-section of said tubular balloon neck segment, wherein said bead-sided sub-section of said tubular balloon neck segment substantially covers a surface of said moldable adhesive cross sectioned profile located proximate said balloon unfinished edge and said body-sided sub-section of said tubular balloon neck segment substantially covers a surface of said moldable adhesive cross sectioned profile located proximate said balloon gas retaining expansion cavity.

6. A self sealing balloon assembly as recited in claim 1, wherein said moldable adhesive cross sectioned profile has a rounded shape.

7. A method of fabricating a self sealing balloon assembly, the balloon assembly having a tubular balloon neck segment extending in fluid communication between a balloon unfinished edge and a balloon gas retaining expansion cavity, the method comprising steps of:

applying a moldable adhesive ring to an interior surface of said tubular balloon neck segment of said balloon, wherein the moldable adhesive ring is fabricated of a tacky moldable material; and positioning said tubular balloon neck segment of said balloon to substantially encase said moldable adhesive ring within a section of said tubular balloon neck segment of said balloon to ensure one area of said moldable adhesive ring and a second area of said moldable adhesive ring do not join with one another until desired by a user.

8. A method of fabricating a self sealing balloon assembly as recited in claim 7, wherein said step of positioning said tubular balloon neck segment of said balloon to substantially encase said moldable adhesive ring is accomplished by:

rolling said tubular balloon neck segment outward about an exterior surface of said tubular balloon neck segment until said moldable adhesive ring is encapsulated within said section of said tubular balloon neck segment of said balloon.

9. A method of fabricating a self sealing balloon assembly as recited in claim 7, wherein said step of positioning said tubular balloon neck segment of said balloon to substantially encase said moldable adhesive ring is accomplished by:

placing a barrier material upon one of an exposed portion of said moldable adhesive ring or an exterior surface of said tubular balloon neck segment; and rolling said tubular balloon neck segment outward about said exterior surface of said tubular balloon neck segment until said moldable adhesive ring is encapsulated within said section of said tubular balloon neck segment of said balloon, wherein said barrier material ensures said moldable adhesive ring from adhering to said exterior surface of said tubular balloon neck segment.

10. A method of fabricating a self sealing balloon assembly as recited in claim 7, wherein said step of positioning said tubular balloon neck segment of said balloon to substantially encase said moldable adhesive ring is accomplished by:

rolling said tubular balloon neck segment outward about an exterior surface of said tubular balloon neck segment until said moldable adhesive ring is encapsulated within said section of said tubular balloon neck segment of said balloon, wherein said rolled portion of said tubular balloon neck segment forms a lip bead of said balloon.

11. A method of fabricating a self sealing balloon assembly as recited in claim 7, wherein said step of positioning said tubular balloon neck segment of said balloon to substantially encase said moldable adhesive ring is accomplished by:

rolling at least one portion of said tubular balloon neck segment inward covering said moldable adhesive ring until said moldable adhesive ring is substantially encapsulated by said at least one portion of said tubular balloon neck segment of said balloon.

12. A method of fabricating a self sealing balloon assembly as recited in claim 7, wherein said step of positioning said tubular balloon neck segment of said balloon to substantially encase said moldable adhesive ring is accomplished by:

rolling a first portion of said tubular balloon neck segment located on a first side of said moldable adhesive ring inward partially covering said moldable adhesive ring; and rolling a second portion of said tubular balloon neck segment located on a second, opposite side of said moldable adhesive ring inward partially covering said moldable adhesive ring, wherein said first said portion of said tubular balloon neck segment and said second portion of said tubular balloon neck segment collectively substantially encapsulate said moldable adhesive ring.

13. A method of fabricating a self sealing balloon assembly as recited in claim 7, wherein said step of positioning said tubular balloon neck segment of said balloon to substantially encase said moldable adhesive ring is accomplished by:

rolling a first portion of said tubular balloon neck segment located on a first side of said moldable adhesive ring inward partially covering said moldable adhesive ring; and rolling a second portion of said tubular balloon neck segment located on a second, opposite side of said moldable adhesive ring inward partially covering said moldable adhesive ring, wherein said first said portion of said tubular balloon neck segment and said second portion of said tubular balloon neck segment are substantially equal to one another in size and collectively substantially encapsulate said moldable adhesive ring.

14. A method of fabricating and filling a self sealing balloon assembly, the balloon assembly having a tubular balloon neck segment extending in fluid communication between a balloon unfinished edge and a balloon gas retaining expansion cavity, the method comprising steps of:

applying a moldable adhesive ring to an interior surface of said tubular balloon neck segment of said balloon, wherein the moldable adhesive ring is fabricated of a tacky moldable material;

positioning said tubular balloon neck segment of said balloon to substantially encase said moldable adhesive ring within a section of said tubular balloon neck segment of said balloon to ensure one area of said moldable adhesive ring and a second area of said moldable adhesive ring do not join with one another until desired by a user;

filling said balloon gas retaining expansion cavity with a volume of one of a gas or a fluid;

exposing said encased moldable adhesive ring from said section of said tubular balloon neck segment; and applying a compression force to said tubular balloon neck segment proximate said moldable adhesive ring causing said exposed moldable adhesive ring to create a seal, retaining said one of said gas or said fluid therein.

15. A method of fabricating and filling a self sealing balloon assembly as recited in claim 14, wherein said step of positioning said tubular balloon neck segment of said balloon to substantially encase said moldable adhesive ring is accomplished by:

rolling said tubular balloon neck segment outward about an exterior surface of said tubular balloon neck segment until said moldable adhesive ring is encapsulated within said section of said tubular balloon neck segment of said balloon.

16. A method of fabricating and filling a self sealing balloon assembly as recited in claim 14, wherein said step of positioning said tubular balloon neck segment of said balloon to substantially encase said moldable adhesive ring is accomplished by:

placing a barrier material upon one of an exposed portion of said moldable adhesive ring or an exterior surface of said tubular balloon neck segment; and rolling said tubular balloon neck segment outward about said exterior surface of said tubular balloon neck segment until said moldable adhesive ring is encapsulated within said section of said tubular balloon neck segment of said balloon, wherein said barrier material ensures said moldable adhesive ring from adhering to said exterior surface of said tubular balloon neck segment.

17. A method of fabricating and filling a self sealing balloon assembly as recited in claim 14, wherein said step of positioning said tubular balloon neck segment of said balloon to substantially encase said moldable adhesive ring is accomplished by:

rolling said tubular balloon neck segment outward about an exterior surface of said tubular balloon neck segment until said moldable adhesive ring is encapsulated within said section of said tubular balloon neck segment of said balloon, wherein said rolled portion of said tubular balloon neck segment forms a lip bead of said balloon.

18. A method of fabricating and filling a self sealing balloon assembly as recited in claim 14, wherein said step of positioning said tubular balloon neck segment of said balloon to substantially encase said moldable adhesive ring is accomplished by:

rolling at least one portion of said tubular balloon neck segment inward covering said moldable adhesive ring until said moldable adhesive ring is substantially encapsulated by said at least one portion of said tubular balloon neck segment of said balloon.

19. A method of fabricating and filling a self sealing balloon assembly as recited in claim 14, wherein said step of positioning said tubular balloon neck segment of said balloon to substantially encase said moldable adhesive ring is accomplished by:

rolling a first portion of said tubular balloon neck segment located on a first side of said moldable adhesive ring inward partially covering said moldable adhesive ring; and rolling a second portion of said tubular balloon neck segment located on a second, opposite side of said moldable adhesive ring inward partially covering said moldable adhesive ring, wherein said first said portion of said tubular balloon neck segment and said second portion of said tubular balloon neck segment collectively substantially encapsulate said moldable adhesive ring.

20. A method of fabricating and filling a self sealing balloon assembly as recited in claim 14, wherein said step of positioning said tubular balloon neck segment of said balloon to substantially encase said moldable adhesive ring is accomplished by:

rolling a first portion of said tubular balloon neck segment located on a first side of said moldable adhesive ring inward partially covering said moldable adhesive ring; and rolling a second portion of said tubular balloon neck segment located on a second, opposite side of said moldable adhesive ring inward partially covering said moldable adhesive ring, wherein said first said portion of said tubular balloon neck segment and said second portion of said tubular balloon neck segment are substantially equal to one another in size and collectively substantially encapsulate said moldable adhesive ring.

* * * * *